US005829747A

United States Patent [19]

Nebel

[11] Patent Number: 5,829,747

[45] Date of Patent: Nov. 3, 1998

[54] STOCK MARKET BIG BOARD GAME

[76] Inventor: Stephen E. Nebel, P.O. Box 72550, Fairbanks, Ak. 99707

[21] Appl. No.: 920,126

[22] Filed: Sep. 2, 1997

[51] Int. Cl.[6] ..... A63F 3/00

[52] U.S. Cl. ..... 273/256

[58] Field of Search ..... 273/242, 243, 273/248, 249, 256, 278, 283, 285

[56] References Cited

U.S. PATENT DOCUMENTS

| | | | |
|---|---|---|---|
| 3,237,948 | 3/1966 | Murray | 273/256 |
| 3,765,682 | 10/1973 | Brando | 273/256 |
| 4,002,342 | 1/1977 | Biggs . | |
| 4,431,195 | 2/1984 | Brand et al. . | |
| 4,452,457 | 6/1984 | Atieh et al. | 273/256 |
| 4,557,486 | 12/1985 | Stuckmayer | 273/278 |
| 4,840,382 | 6/1989 | Rubin | 273/278 X |
| 4,934,707 | 6/1990 | Koster . | |
| 5,139,269 | 8/1992 | Peterson | 273/256 |
| 5,407,207 | 4/1995 | Stanford . | |

*Primary Examiner*—William E. Stoll
*Attorney, Agent, or Firm*—Michael I. Kroll

[57] ABSTRACT

A stock market big board game comprising a game board (14) having a continuous path around its perimeter (16) divided into consecutive spaces (18) bearing instructions for price fluctuations of individual companies and the market as a whole, market manipulation card purchase options, penalties, bonuses for stock diversification, move anywhere options, puts and calls, market trend changes, and stock price move options with each of the spaces (18) defining a playing position. A big board (20) is provided with a structure (22) for mounting the big board (20) vertically to the game board (14). A plurality of price marker pegs (24) for the big board (20), indicate on the big board (20) the activities of seven types of stocks purchased, such as stock prices and splits. A plurality of playing pieces (26) are provided, one for each of the game players. The playing pieces (26) being of a size to fit within the playing positions. Play money (28) of different denominations are for distribution of part thereof to each player. A random number generating facility (30) is for designating a number of spaces (18) on the game board (14) to be moved by each playing piece (26). A market trend indication piece (32) has a bull head (34) on one side and a bear head (36) on an opposite side. A deck of market manipulation cards (38), a deck of market fluctuation cards (40), a plurality of stock certificates (42) and a plurality of certificates of deposit (44) are also used in the game.

25 Claims, 6 Drawing Sheets

20

Fig. 2A

The Big Board

| GM | CT | IA | US | NY | SP | RS |
|---|---|---|---|---|---|---|
| 1 2 3 4 Splits | 1 2 3 4 Splits | 1 2 3 4 Splits | 1 2 3 4 Splits | 1 2 3 4 Splits | 1 2 3 4 Splits | 1 2 3 4 Splits |

Current Market Values

| | | | | | | |
|---|---|---|---|---|---|---|
| 100 | 100 | 100 | 100 | 100 | 100 | 100 |
| 98 | 98 | 98 | 98 | 98 | 98 | 98 |
| 96 | 96 | 96 | 96 | 96 | 96 | 96 |
| 94 | 94 | 94 | 94 | 94 | 94 | 94 |
| 92 | 92 | 92 | 92 | 92 | 92 | 92 |
| 90 | 90 | 90 | 90 | 90 | 90 | 90 |
| 88 | 88 | 88 | 88 | 88 | 88 | 88 |
| 86 | 86 | 86 | 86 | 86 | 86 | 86 |
| 84 | 84 | 84 | 84 | 84 | 84 | 84 |
| 82 | 82 | 82 | 82 | 82 | 82 | 82 |
| 80 | 80 | 80 | 80 | 80 | 80 | 80 |
| 78 | 78 | 78 | 78 | 78 | 78 | 78 |
| 76 | 76 | 76 | 76 | 76 | 76 | 76 |
| 74 | 74 | 74 | 74 | 74 | 74 | 74 |
| 72 | 72 | 72 | 72 | 72 | 72 | 72 |
| 70 | 70 | 70 | 70 | 70 | 70 | 70 |
| 68 | 68 | 68 | 68 | 68 | 68 | 68 |
| 66 | 66 | 66 | 66 | 66 | 66 | 66 |
| 64 | 64 | 64 | 64 | 64 | 64 | 64 |
| 62 | 62 | 62 | 62 | 62 | 62 | 62 |
| 60 | 60 | 60 | 60 | 60 | 60 | 60 |
| 58 | 58 | 58 | 58 | 58 | 58 | 58 |
| 56 | 56 | 56 | 56 | 56 | 56 | 56 |
| 54 | 54 | 54 | 54 | 54 | 54 | 54 |
| 52 | 52 | 52 | 52 | 52 | 52 | 52 |
| 50 | 50 | 50 | 50 | 50 | 50 | 50 |
| 48 | 48 | 48 | 48 | 48 | 48 | 48 |
| 46 | 46 | 46 | 46 | 46 | 46 | 46 |
| 44 | 44 | 44 | 44 | 44 | 44 | 44 |
| 42 | 42 | 42 | 42 | 42 | 42 | 42 |
| 40 | 40 | 40 | 40 | 40 | 40 | 40 |
| 38 | 38 | 38 | 38 | 38 | 38 | 38 |
| 36 | 36 | 36 | 36 | 36 | 36 | 36 |
| 34 | 34 | 34 | 34 | 34 | 34 | 34 |
| 32 | 32 | 32 | 32 | 32 | 32 | 32 |
| 30 | 30 | 30 | 30 | 30 | 30 | 30 |
| 28 | 28 | 28 | 28 | 28 | 28 | 28 |
| 26 | 26 | 26 | 26 | 26 | 26 | 26 |
| 24 | 24 | 24 | 24 | 24 | 24 | 24 |
| 22 | 22 | 22 | 22 | 22 | 22 | 22 |
| 20 | 20 | 20 | 20 | 20 | 20 | 20 |
| 18 | 18 | 18 | 18 | 18 | 18 | 18 |
| 16 | 16 | 16 | 16 | 16 | 16 | 16 |
| 14 | 14 | 14 | 14 | 14 | 14 | 14 |
| 12 | 12 | 12 | 12 | 12 | 12 | 12 |
| 10 | 10 | 10 | 10 | 10 | 10 | 10 |
| 8 | 8 | 8 | 8 | 8 | 8 | 8 |
| 6 | 6 | 6 | 6 | 6 | 6 | 6 |
| 4 | 4 | 4 | 4 | 4 | 4 | 4 |
| 2 | 2 | 2 | 2 | 2 | 2 | 2 |
| 0 | 0 | 0 | 0 | 0 | 0 | 0 |

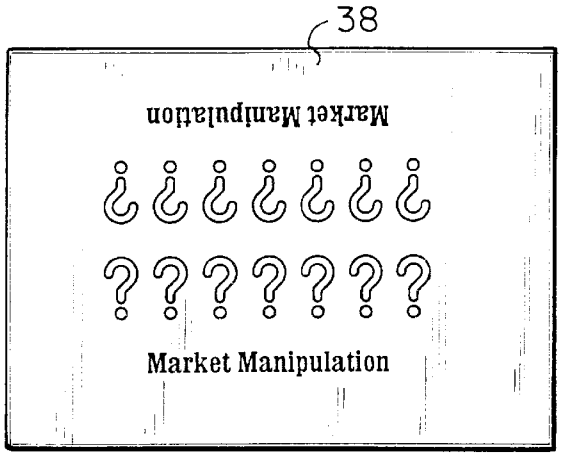
Fig. 10
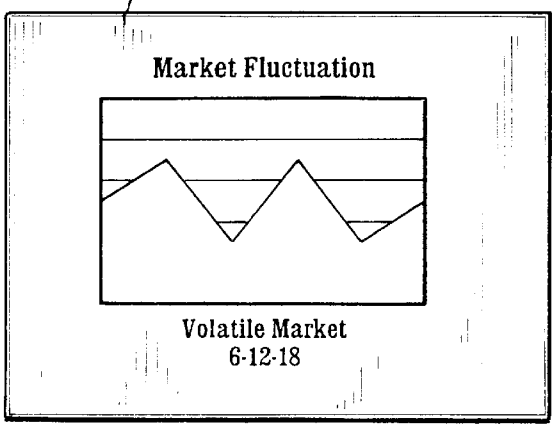
Fig. 11
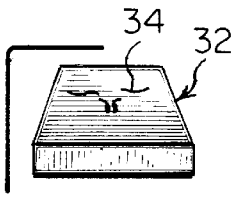
Fig. 7
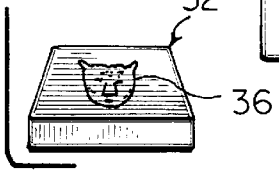
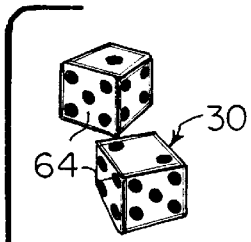
Fig. 8
Fig. 9
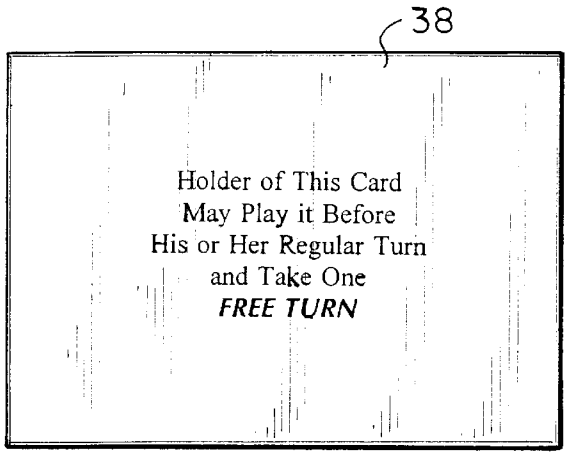
Fig. 10a
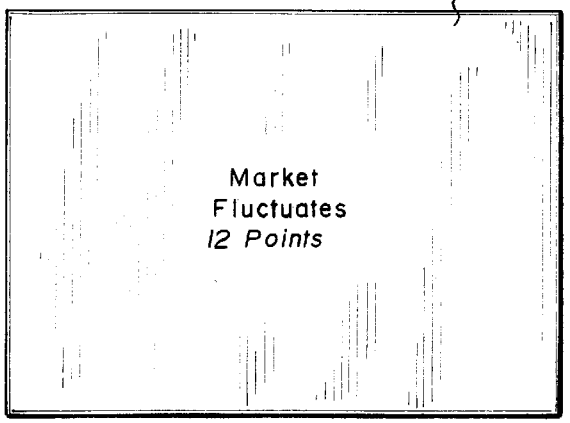
Fig. 11a

STOCK MARKET BIG BOARD GAME

BACKGROUND OF THE INVENTION

1. Field of the Invention

The instant invention relates generally to board games and more specifically it relates to a stock market big board game. The stock market big board game simulates for each player security transactions within the stock market to see which player accumulates the most wealth to win the game.

2. Description of the Prior Art

Numerous board games have been provided in prior art. For example, U.S. Pat. Nos. 4,002,342 to Biggs; 4,431,195 to Brand et al.; 4,934,707 to Koster and 5,407,207 to Sanford all are illustrative of such prior art. While these units may be suitable for the particular purpose to which they address, they would not be as suitable for the purposes of the present invention as heretofore described.

BIGGS, FRED CONNER

STOCK MARKET INVESTMENT GAME

U.S. Pat. No. 4,002,342

A stock market game in which dice determine the current market condition as represented by the Dow Jones Averages. The dice values of two to twelve determine the Dow Jones Averages corresponding to values between two hundred and twelve hundred. A series of stocks are associated with spaces on a top disc and stock prices on a bottom disc are visible through windows in the top disc. The top disc is divided radially into a series of recording spaces corresponding to the stock price for a given market condition. A series of game control spaces determine when the market condition is changed to a different Dow Jones Average, and results in a new market price for the individual stocks.

DONALD L.

BRAND, MOLLY C.

BRAND, GEORGE

STOCK MARKET TRANSACTION BOARD GAME

U.S. Pat. No. 4,431,195

A board game comprising a game board divided into a plurality of horizontally and vertically disposed rows of squares, the horizontal rows constituting a game track extending from one corner of the board to the diagonally opposite corner. The squares represent companies the stocks of which are traded between players and between players and the board, the squares being divided into debit and credit sides. Special security transaction squares are also provided on the game board for transactions between players or between players and the board. A portfolio card is provided for each player, the surface of which reflects the companies appearing on the game board, so that each player can keep a record of his stock portfolio. The game is further provided with accessory pieces in the form of markers to record players movement across the track of the board; a pair of dice in response to the roll of which movement of a marker is made; stock certificates of the companies represented on the game board; simulated currency for engaging in stock transactions; and debit and credit cards used in one of the special security transactions.

KOSTER, JOHN S.

STOCK MARKET BOARD GAME

U.S. Pat. No. 4,934,707

A board game consists of a hexagonal playing board divided into six playing areas, each area designated for one player, and having a central hexagonal area. Each playing area is subdivided into a plurality of unit areas, radiating from the central area. Each playing area having the same number of unit areas. Each unit area bears a representation of the name or trademark of one of a set of companies and each playing area having the same set of companies. Players use imitation money to buy blocks representing shares which are dealt with in accordance with a plurality of randomly distributed playing cards, each equating to a rise or fall in share prices. The blocks bought by the players are placed on the unit areas of the player's corresponding playing areas indicating which companies the players have bought stock in and the number of shares.

STANFORD CARLTON R.

BOARD GAME SIMULATING FINANCIAL EVENTS OF A LIFETIME

U.S. Pat. No. 5,407,207

A game simulating financial events that a person encounters during the person's lifetime, including: a game board having disposed thereon a path of individual financial event indicia on which indicia playing pieces may land while traversing the path, the financial event indicia indicating, in some cases, mandatory or discretional financial transactions. One of the indicia being a starting point at which each player begins the game at a first predetermined age, with age advancing one year each time the starting point is passed, up to a second predetermined age at which the game terminates. First cards, each of which indicates thereon a job and a salary therefor, each player to draw one of the first cards when the game commences. Second cards, each of which indicates thereon a type of business, the purchase price thereof, and the annual profits therefrom, one of the second cards to be drawn by a player, at the discretion thereof, when having a playing piece land on one of the indicia indicating a discretionary financial transaction to be made. Random number generating mechanism to be alternatingly activated by the players to determine a number of the financial event indicia to be transversed by each the playing piece for each move thereof.

SUMMARY OF THE INVENTION

A primary object of the present invention is to provide a stock market big board game that will overcome the shortcomings of the prior art devices.

Another object is to provide a stock market big board game that requires each player to maintain skill in making various investment decisions during the play of the game.

An additional object is to provide a stock market big board game wherein the object of the game is for the player with the most valuable stock portfolio at the end of the game, to be declared the winner of the game.

A further object is to provide a stock market big board game that is simple and easy to use.

A still further object is to provide a stock market big board game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 2A is an enlarged front elevational view with parts broken away of the big board taken in the direction of arrow 2A in FIG. 1.

FIG. 7 is an enlarged perspective view, showing opposite sides of the market trend indicator piece as indicated by arrow 7 in FIG. 1.

FIG. 8 is an enlarged perspective view of the pair of dice as indicated by arrow 8 in FIG. 1.

FIG. 9 is a perspective view of one of the pegs used in the big board.

FIG. 10 is a front plan view of one market manipulation card as indicated by arrow 10 in FIG. 1.

FIG. 10*a* is a rear plan view of the market manipulation card of FIG. 10.

Figure 1:
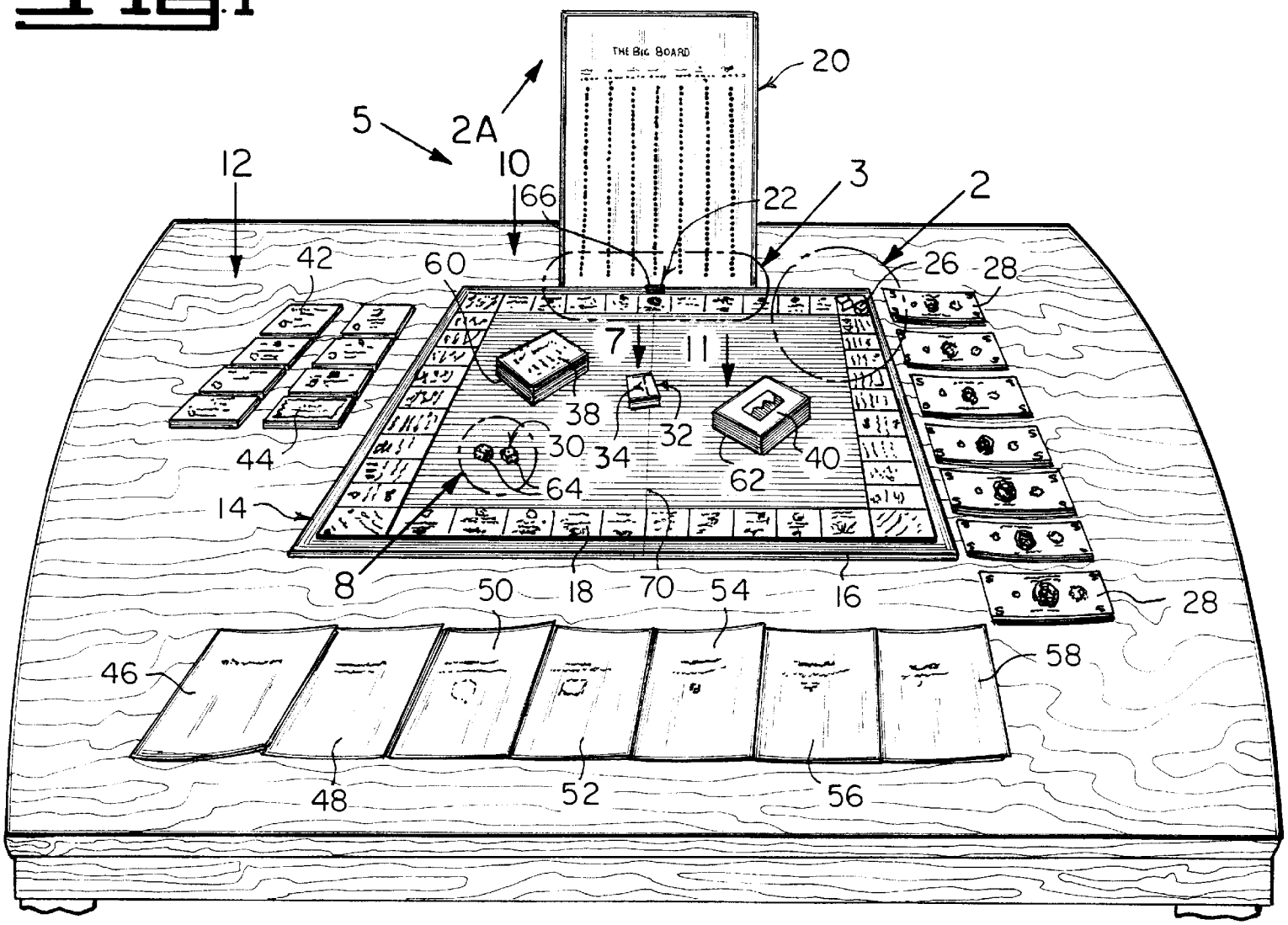
FIG. 1 is a front perspective view showing the various components of the instant invention.
Figure 2:
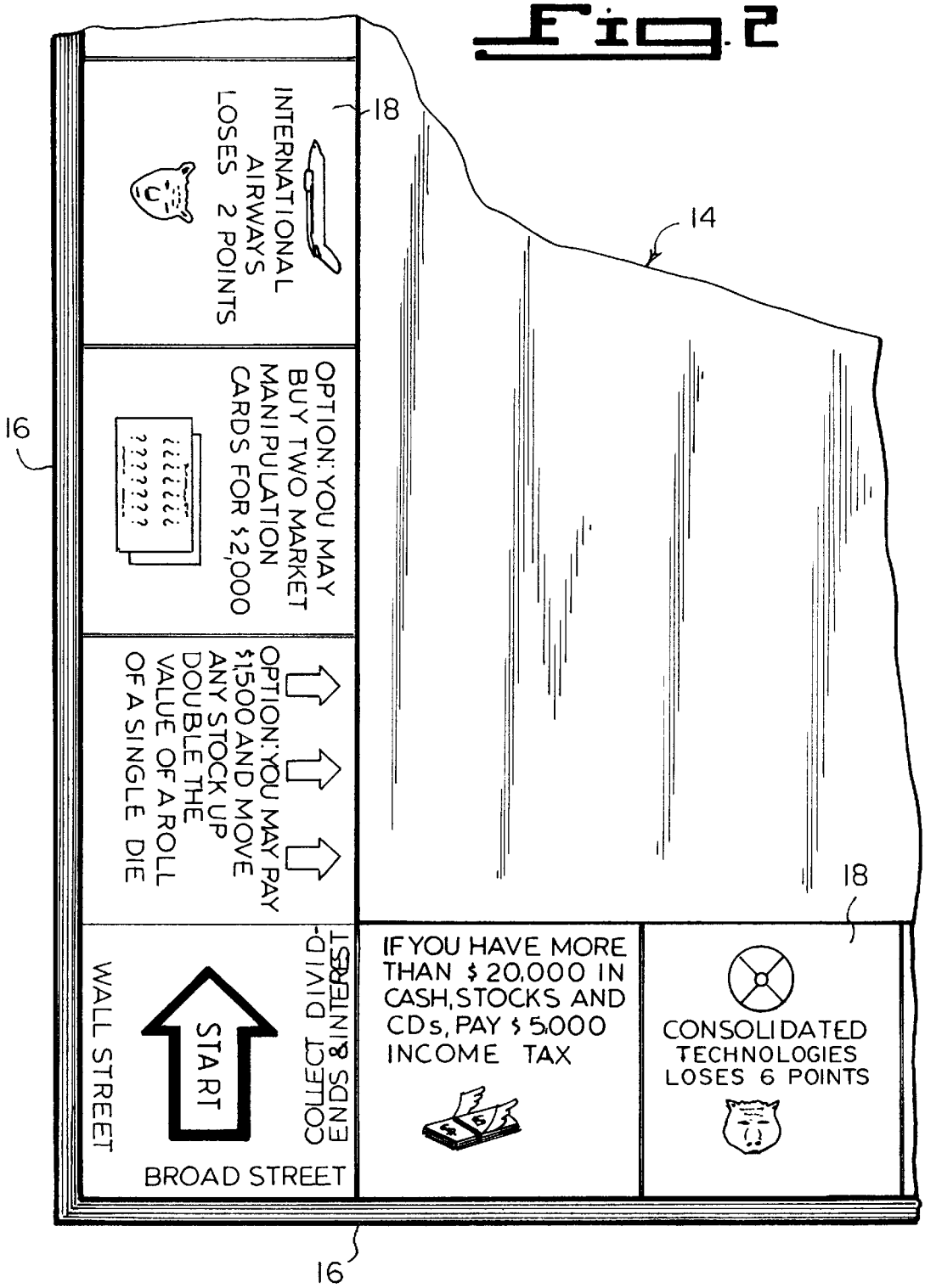
FIG. 2 is an enlarged plan view of a portion of the game board as indicated by arrow 2 in FIG. 1.

FIG. 11 is a front plan view of one market fluctuation card as indicated by arrow 11 in FIG. 1.

FIG. 11*a* is a rear plan view of the market fluctuation card of FIG. 11.

Figure 12:
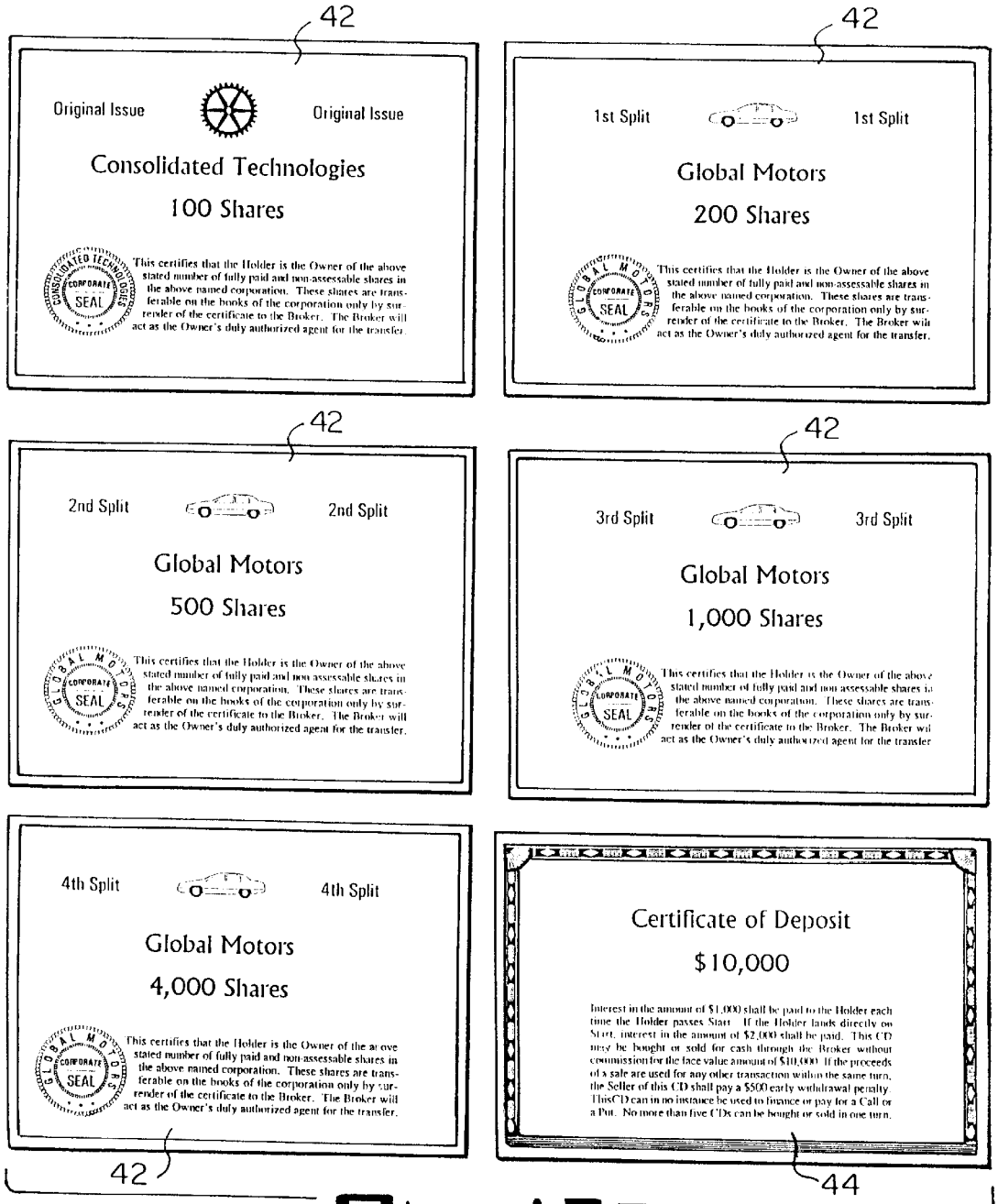

FIG. 12 is a front plan view showing some of the stock certificates and one certificate of deposit.

Similar reference characters denote corresponding features consistently throughout the attached drawings.

DESCRIPTION OF THE PREFERRED EMBODIMENTS

Turning now descriptively to the drawings, in which similar reference characters denote similar elements throughout the several views, FIGS. 1 through 12 illustrate the various components of the stock market big board game of the present invention. With regard to the reference numerals used, the following numbering is used throughout the various drawing figures.

| | |
|---|---|
| 14 | game board |
| 16 | perimeter of 14 |
| 18 | space on 14 |
| 20 | big board |
| 22 | mounting structure for 20 to 14 |
| 24 | price marker peg for 20 |
| 26 | playing piece |
| 28 | play money |
| 30 | random number generating facility |
| 32 | market trend indication piece |
| 34 | bull head on 32 |
| 36 | bear head on 32 |
| 38 | market manipulation card |
| 40 | market fluctuation card |
| 42 | stock certificate |
| 44 | certificate of deposit |
| 46 | rules for big board pamphlet |
| 48 | big board regulations pamphlet |
| 50 | stock market primer pamphlet |
| 52 | big board prospectus pamphlet |
| 54 | stock purchase table pamphlet |
| 56 | stock sales table pamphlet |
| 58 | dividend payout and yield tables pamphlet |
| 60 | first card area on 14 |
| 62 | second card area on 14 |
| 64 | pair of dice for 30 |
| 66 | clip for 22 |
| 68 | bottom edge of 20 |
| 70 | fold line on 14 |
| 72 | storage box with cover |

The stock market big board game comprises a game board 14 having a continuous path around its perimeter 16 divided into consecutive spaces 18 bearing instructions for price fluctuations of individual companies and the market as a whole, market manipulation card purchase options, penalties, bonuses for stock diversification, move anywhere options, puts and calls, market trend changes, and stock price move options with each of the spaces 18 defining a playing position. A big board 20 is provided with a structure 22, for mounting the big board 20 vertically to the game board 14. A plurality of price marker pegs 24 for the big board 20 indicate on the big board 20, the activities of seven types of stocks purchased, such as stock prices and splits. A plurality of playing pieces 26 are provided, one for each of the game players. The playing pieces 26 being of a size to fit within the playing positions. Play money 28 of different denominations are for distribution of part thereof to each player. A random number generating facility 30 is for designating a number of spaces 18 on the game board to be moved by each playing piece 26. A market trend indication piece 32 has a bull head 34 on one side and a bear head 36 on an opposite side. A deck of market manipulation cards 38, a deck of market fluctuation cards 40, a plurality of stock certificates 42 and a plurality of certificates of deposit 44 are also used in the game.

The stock market big board game further includes a rules for big board pamphlet 46, a big board regulations pamphlet 48, a stock market primer pamphlet 50, a big board prospectus pamphlet 52, a stock purchases table pamphlet 54, a stock sales table pamphlet 56 and a dividend payout and yield tables pamphlet 58.

The playing pieces 26 represent figurines of animate and inanimate objects. The game board 14 further includes two card areas 60 and 62. The first area 60 is for storing the deck of market manipulation cards 38 prior to purchase by the players. The second area 62 is for storing the deck of market fluctuation cards 40. One market fluctuation card 40 is turned, each time one playing piece 26 lands on the playing position labeled market fluctuation on the game board 14. The game board 14 is square, with the continuous path forming a further inner square within the perimeter 16 of the game board 14.

Figure 3:
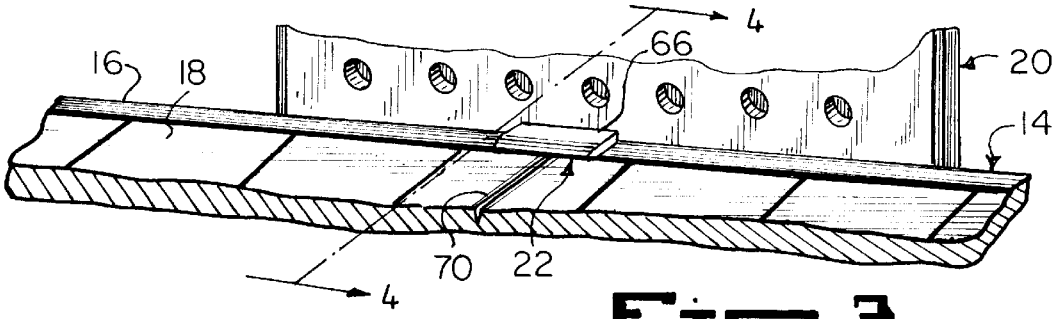
FIG. 3 is an enlarged front perspective view, showing a portion of the big board and the game board as indicated by arrow 3 in FIG. 1.
Figure 4:
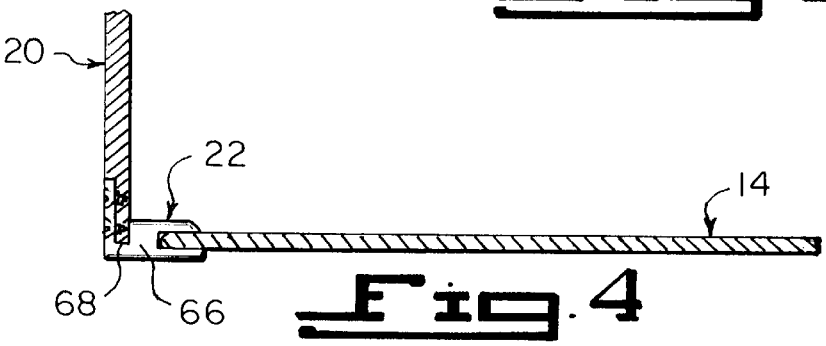
FIG. 4 is a cross sectional view taken along line 4—4 in FIG. 3.
Figure 5:
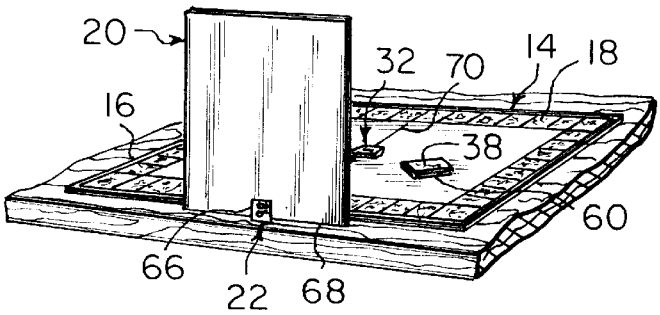
FIG. 5 is a rear perspective view taken in the direction of arrow 5 in FIG. 1, with some of the components removed therefrom.

The play money 28 includes a plurality of papers bearing indicia representing denominations of money. The denominations of money are of $100 dollars, $500 dollars, $1,000 dollars, $5,000 dollars, $10,000 dollars, $20,000 dollars and $100,000 dollars. The random number generating facility 30 is a pair of dice 64. The mounting structure 22, as best seen in FIGS. 3 and 4, is a clip 66 affixed at a right angle to a bottom edge 68 of the big board 20, so that the clip 66 can engage with one edge of the game board 14.

The deck of market manipulation cards 38 allows each player that buys one of these cards to perform various manipulations, and includes thirty six cards. Five are free turn cards, five cards are to turn the market Bull and five cards are to turn it Bear. Each of seven companies represented in the game have a card to move it up twenty points, a card to move it up ten points and an SEC card to punish either of the two prior manipulations.

The deck of market fluctuation cards 40 includes twenty eight cards at four different volatility levels being stable, active, volatile and extremely volatile, in which the point values for the four levels are as follows. Stable—four cards with a two point move, two cards with a four point move and one card with a six point move. Active—four cards with a four point move, two cards with an eight point move and one card with a twelve point move. Volatile—four cards with a six point move, two cards with a twelve point move and one card with an eighteen point move. Extremely volatile—four cards with a twelve point move, two cards with an eighteen point move and one card with a twenty four point move.

The stock certificates 42 are for each of seven companies represented on the big board 20, which are Global Motors; Consolidated Technologies, International Airways, United Speculators, New York Gas and Electric, Solar Power and Ralph's Shoes. The stock certificates 42 are divided into an original issue and four split levels, to provide an easy and natural bookkeeping for results of the splits.

Figure 6:
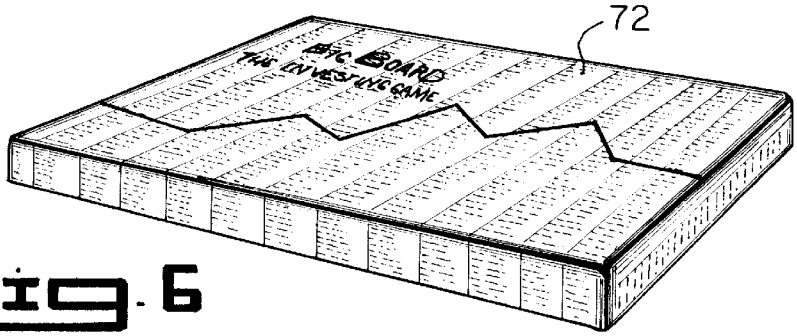
FIG. 6 is a perspective view, showing the cover for the game.

The stock market big board game further includes the game board 14 having a fold line 70 thereacross, so that the game board 14 can be folded in half. A storage box with a cover 72, as shown in FIG. 6, holds the folded game board 14 and all of the various components of the game therein when not being used.

THE RULES FOR BIG BOARD

Object: Invest wisely and end the game with more money in cash, CDs and stocks than the other players.

Equipment: The Big Board; The Game Board; Dice; Money; Certificates of Deposit; Stock Certificates; Market Manipulation and Market Fluctuation Cards; BULL/BEAR Market Trend Marker; Big Board Prospectus; Big Board Stock Purchases Table; Big Board Stock Sales Table; Big Board Stock Market Primer; The Rules for Big Board; The Big Board Regulations.

Preparation: Place The Big Board near the game board and on the Big Board set the price marker pegs to indicate an $80 per share value for Global Motors, a $70 per share value for Consolidated Technologies, and so on moving right and down. See the Big Board Prospectus for full information on initial stock values. Place the remaining pegs near the Big Board. These will be used to mark splits when and if they occur during the course of the game. Shuffle both decks of cards and place them in the appropriate squares on the game board. Place the BULL/BEAR market trend indicator in the middle of the game board. Arrange the stock certificates for each company near the board in the following order. Original shares on top, 1st Split shares next, 2nd Split shares next, and so forth. One player may be designated broker to handle the money and certificates, or this duty may be divided, one player handling the money and another the certificates. There is no advantage or disadvantages in performing the duties of the broker. Each player begins the game with a single $20,000 bill.

Beginning the Play: All players roll a single die, highest player goes first. The player going first now rolls another single die. If the number is even, the BULL/BEAR indicator is turned to BULL, if odd, to BEAR. This establishes the initial market direction. The first player now cuts the Market Fluctuation deck. This establishes the initial market volatility level.

The first player may now buy as many shares of stock as he chooses, and can afford, in any one of the seven companies on the Big Board, or may buy CDs. All stock trading is done in "round lots", that is, one hundred share units. Commissions are $1 per share to buy a $1 per shared to sell. The Bid Board Stock Purchase and Sale Tables provide totals for both buy and sell transactions of up to 2,000 shares. CDs are bought and sold without commission. After making his decision to buy or not, the first player then rolls the dice and moves the number of spaces indicated. The instructions on the square are followed, and the second player begins.

As the play progresses and players develop a stock portfolio, they may then either buy or sell as many shares of one company as they wish at the beginning of their turns, or may buy or sell for cash up to five CDs. A player may not buy and sell stock, or deal in the stock of more than one company. Stocks may be bought with CDs, but a player may not receive CDs in exchange for stock. CDs used to buy stock are subject to a $500 early withdrawal penalty. As play progresses, and players begin to acquire Market Manipulation cards, an additional choice arises. A player holding Market Manipulation cards may now either buy or sell stock or CDs, or use a card.

Market Manipulation Cards: Market Manipulation cards can be bought at various option squares on the game board. Each company on the Big Board has two cards in the Market Manipulation deck which will cause the value of the stock to rise, one causing a 10-point rise and the other causing a 20-point rise. A player must own stock in any company he tries to manipulate. Each company also has one SEC card which can be used to reverse an upward manipulation on the part of another player. An SEC card will drop the stock twenty points from its pre-manipulation value. The SEC card is the only card that can be played "out of turn", that is, if a player holding the appropriate SEC card chooses to reverse a manipulation, he must play the card immediately in response to the other player's action and does not wait until his own turn.

The Market Manipulation deck contains three other types of cards. The BULL cards will reverse a BEAR market, without, however, causing an immediate fluctuation as the BULL square on the game board does. The market cannot be again reversed with a Market Manipulation card until the following player has completed his turn (or turns if he uses a FREE TURN card). The market can be reversed earlier, however, if a player lands on the BEAR square. The rules for the BEAR cards are the same. The FREE TURN cards allow a player to take two turns in a row. If a player intends to use a FREE TURN card, he must play it at the start of his regular turn before rolling the dice or performing any buy or sell transaction. A player may not use two FREE TURN cards in a row.

Market Fluctuation Cards: Each time a player lands on a Market Fluctuation square a Market Fluctuation Card is turned and all stocks on the Big Board advance or drop by the value indicated, depending on whether the market is BULL or BEAR at the time the card is turned. The BULL is the symbol of a rising market; the BEAR is the symbol of a falling market.

Splits and Bankruptcy: The Big Board indicates stock values along a range of zero to $100 dollars per share in $2 increments. If the stock of any company drops to zero, the company is bankrupt and its stock is worthless. For the remainder of the game, the two game board squares corresponding to this company function as Market Fluctuation squares. If the stock of a company goes over 100, it splits 2 for 1. If a stock has advanced to an odd number, such as 105, the price is advanced to the highest even number then divided by two. If the stock has advance to an even number, like 106, it is just divided by 2. If the split takes the stock down to an odd number, such as 53, add one to the final split value, here 54. Once the peg is moved to reflect the new value, add a peg to the split counter for the stock at the top of the Big Board to record the split.

Any players holding this stock now get a share distribution which doubles the number of shares held. After distribution of the shares, the player responsible for the split, whether through a move on the game board or a successful manipulation, rolls a single die and the stock is moved up double this value.

After the first split, the pool of available shares for a company is doubled. That is, both the original issue and the shares in the first split level are now available for trading. Shares in the second split level, however, are not available for trading unless the stock splits again.

Start: Players passing START collect $100 interest if they hold any cash whatsoever, plus $1,000 dollars for every CD held, plus dividends for companies in which they own stock. The Big Board Prospectus lists the dividend payout for all companies on the Big Board. Players who hit START directly get paid double. Divided pay outs remain the same per hundred shares after stock splits. However, any company whose stock falls below 10 suspends dividend payments until the stock rises to 10 or above again.

Fluctuation Squares for Individual Companies: In addition to the Market Fluctuation squares on the game board, which cause all companies to either rise or fall together, there are two fluctuation squares for each individual company on the Big Board. These squares cause the stock to behave according to the inherent volatility or stability of the company itself. The Big Board Prospectus describes these individual characteristics.

Certificates of Deposit (CDs): CDs are bought and sold without commission costs. A player may buy or sell up to five $10,000 CDs during his turn. CDs may not be used in Puts and Calls, buy may otherwise be used in place of cash in all other instances. However, CDs used in place of cash are each subject to a $500 early withdrawal penalty and at no time may more than five CDs be cashed in. As in regular stock purchases, a player may not both purchase stock with CDs and play a Market Manipulation card.

Calls and Puts: The CALL allows a player to force any other player to sell him 100 shares of stock at half price. The PUT allows a player to force any other player with the cash to buy 100 shares of stock at double the price. CDs cannot be used to finance a CALL, nor can a player be forced to cash a CD or sell stock to pay the price of a PUT. The player forcing the CALL or PUT pays a $200 commission to the broker.

Tax Loss Carryforward Credit: A player landing on the Tax Loss Carryforward Credit totals the value of all cash, CDs and stocks in determining his eligibility for the $5,000 credit. Stocks are valued at the net sale amounts listed in the Big Board Stock Sales Table. A player may not qualify for the credit by exercising a Move Anywhere option which has the effect of reducing his holdings below $20,000.

Margin Call: A player may elect to pay a Margin Call in any combination of cash, CDs or stocks, but may not receive back change if short on cash or CDs and thereby forced to sell stock of greater value than the amount needed to meet the Margin Call. Stocks are valued at the rates posted in the Big Board Stock Sales Table.

Random Walk: Player may choose any stock on the Big Board, then roll one die to establish the price move direction. If the roll is odd, the stock will fall, if even, the stock will rise. The Player then rolls both dice and the stock is moved up or down double the value of the second row.

Federal Income Tax: A player may elect to pay in any combination of cash or stocks. Player may receive back change if he is short on cash or CDs and if forced to sell stock of greater value than the amount needed to pay the tax. Stocks are valued at the net sale amounts in the Big Board Stock Sales Table.

Doubles: Players rolling doubles 2s, 3s, 4s or 5s collect $1,000. Players rolling double 1s or 6s may either move the count shown on the dice and collect $1,000, or pay $500 and move anywhere. Players may not completely circle the board and land on the original square.

The Big Board Regulations: Just as Federal and State securities laws are supplemented by regulatory rulings, the Rules for Big Board are supplemented by the Big Board Regulations. Consult the regulations for any matters arising during the course of a game that are not directly resolved by the rules.

End of the Game: The game ends when the last Market Fluctuation card is turned and the results are posted to the Big Board, or when all of the companies on the Big Board go bankrupt, or when only one player with assets is left in the game. Winner is the player with the greatest value in cash, CDs and stocks. Use the Big Board Stock Sales Table to value stocks. Count cash and CDs at face value.

BIG BOARD REGULATIONS

Cases Not Covered By The Rules

Dice: During rolls the die or dice must land touching only the game board. A die or dice may overhang the edge of the board as long as it doesn't touch the table or other surface the board is resting on. A die may not land touching the card decks, the BULL/BEAR indicator, another die or any other object. In cases too close to determine, the originally rolling player and any other player each roll one die the high player gets to determine the validity of the roll in dispute. The same dice rules apply to rolls conducted to determine the validity of prior rolls. In misrolls involving both dice, both are rerolled even though only one may have landed improperly. In ties in determining the player who starts the game, only those players tied roll again to break the tie.

Market Manipulation Cards: A player may not play a Market Manipulation Card to raise the price of a stock, then play the corresponding SEC card. Also, a player holding an SEC card is not required to play it in response to a manipulation. If the card is not played, however, the opportunity is forfeited and card may not be used unless another manipulation of the stock occurs.

SEC cards can only be used to stop stock manipulation attempted by means of Market Manipulation cards. An SEC card cannot be used, for example, to stop an upward stock movement done with the roll up option or the Random Walk square, or a Move Anywhere to a stock's up fluctuation square.

If the Market Manipulation Card deck has been sold out to the point where only a single card remains, and a player lands on an option square where he could buy 2 cards for $2,000, he may buy the single card for $1,000. If the Market Manipulation Card deck is entirely sold out, the option squares pertaining to the cards then become neutral. They do not cause market fluctuations as do the squares corresponding to bankrupt companies.

If the market is already BULL, a player may not play another BULL card simply to lock in the trend through the turn of the following player. Same with BEAR cards.

Margin Call: A player can receive change back from CDs or bills of any denomination, but not from units of stock that have to be sold to meet the Call. For example, if a player lands on the $4,000 Margin Call while holding $3,000 cash and 100 shares of stock currently valued at $80 per share, he must forfeit the entire 100 share block of stock.

Free Turns: Free turns offer the player the same buy and sell rights as do regular turns. For the purposes of these regulations, when a player uses a Free Turn card, his first turn is deemed to be the Free Turn and his next turn is considered to be his regular turn.

Running Out of Stock, CDs or Cash: In the unlikely event that any of the three types of assets are totally distributed among players, paper IOUs of the appropriate type can be created to allow the game to continue. The standard Big Board issues of stock, CDs and cash are not intended to place any limits on the availability of these assets.

Trades of Greater Than 2,000 Shares: The Big Board Stock Purchase and Sale Schedules will cover the great majority of trades that will occur during the normal course of a game. The Price Schedules are not intended to set a maximum on the number of shares that can be traded. To calculate the cost or proceeds from large trades, use the schedules in an additive manner. That is, if you are buying 2,400 shares at $20, simply add the cost of 2,000 shares @20/share, $42,000 to the cost of 400 shares @20/share, $8,400, to get the net purchase price of $50,400.

The Big Board Dividend Payout Table can be used to calculate the dividend pay outs when large numbers of shares are held.

Stock Splits and Stock Certificates: The stock certificates for the Big Board companies are labeled to identify them as part of the original issue, the first split, and so forth. These labels are only used to determine the total number of shares available for trading at any particular time. When a stock splits, the shares in the original issue and the first split distribution are for all purposes equal. If at the time of a split, one player is holding all the small share units of a particular issue, and exchanges of denominations are required to complete the distribution, all players are obligated to cooperate in "making change" until the distribution is successfully completed.

All stock price moves in Big Board are done in $2 increments. After splits, price adjustments may be necessary to ensure that the result of the split does not result in a stock having an odd number price valuation. The following schedule provides examples of split adjustments for a range of common stock split situations:

| Stock Advances To | Pre-Split Adjustment | Stock Splits To | Post-Split Adjustment |
|---|---|---|---|
| 101 | 102 | 51 | 52 |
| 102 | none | 51 | 52 |
| 103 | 104 | 52 | none |
| 104 | none | 52 | none |
| 105 | 106 | 53 | 54 |
| 106 | none | 53 | 54 |
| 107 | 108 | 54 | none |

Move Anywhere: A player rolling double 1s or 6s and playing $500 for a Move Anywhere option can move from 1 to 39 squares in a forward direction. A player landing on a game board Move Anywhere square and paying $1,500 can likewise move from 1 to 39 squares forward from the game board square. In no case can a player use either double 1s or 6s or a game board Move Anywhere to move to a Move Anywhere game board square. Otherwise, a player collecting more than $3,000 at Start could circle endlessly via the two Move Anywhere squares, slowly building a fortune in dividends and interest.

Transaction Finalization: All buy and sell transactions are deemed complete when the exchange of stock, CDs, Market Manipulation cards and/or cash is complete. A player may rescind a transaction at any time prior to that point. A player may not rescind a transaction simply because he hasn't rolled the dice for his turn. A transaction may be rescinded if the player can show the transaction was in error in the amount of money either paid or received. Once the player rolls the dice for his turn, all transactions are deemed final regardless of error.

Start: Any player forgetting to collect interest or dividends before the end of his turn upon passing or landing on Start forfeits any such interest and/or dividends. A player's turn ends when the next player rolls the dice. If a player pays a Free Turn card, the result of which makes him eligible for dividends and/or interest, and then rolls the dice for his or her regular turn prior to collecting any such dividends and/or interest, such dividends and or interest are forfeit.

Dividends: If a company's price per share is below 10 at the time a player crosses Start, no dividends are issued to players holding stock in the company even though the end result of the move may be to advance the company's per share value to $10 or above. Conversely, if a company's value is 10 or above at the time the player passes Start, dividends are paid even though the end effect of the move may be to move the company's value below 10.

Certificates of Deposit: CDs can be used for the purchase of stock or any other Big Board expenditure except for the financing of a Call. However, any CD exchanged for anything other than cash is subject to a $500 early withdrawal penalty. Other than the penalty, a player may receive change for the unspent amount of any CD used to meet a Margin Call. No player can be forced to cash CDs to comply with an attempted Put by another player. No more than five CDs can be used during a single turn.

A player may use CDs in place of cash as described above, but cannot conduct more than one type of transaction. That is, a player may not both buy stock with several CDs and exchange several additional CDs for cash during the same turn.

Public Accounting: All Big Board transactions and the assets held by any player are not to be kept secret. Any player may request an accounting at any time during the game. Any such accounting may be approximate rather than exact, unless the requesting player requests an exact count of assets held.

BIG BOARD

A Stock Market Primer

Shares of stock represent units of ownership in a corporation. In the United States, many of the major business corporations such as IBM and General Motors are publicly owned by thousands of individual investors. Shares of stock in publicly held companies are traded on public stock exchanges. There are several stock exchanges in the United States, some of regional and some of national scope. The largest and one of the oldest of the exchanges is the New York Stock Exchange, otherwise known as the Big Board.

The exchanges exist to provide liquidity for the owners of stock. That is, the exchanges provide a ready market for buyers and sellers. The per share valuations of publicly traded companies generally fluctuate daily in accord with the rise and fall in demand for the stock.

The business sections of many newspapers carry the results of the prior day's trading on the Big Board, and often for several of the smaller exchanges as well. The cover of Big Board displays actual trading results for various companies on the New York Stock Exchange as of the close of trading on Aug. 15, 1996. We'll take a look at one of those companies, Texas Instruments, with column headings as they typically appear in a newspaper.

| 52 Week | | | | | | Vol | | Net |
|---|---|---|---|---|---|---|---|---|
| Hi | Lo | Stock | SYM | Div | PE | 100s | Last | Chng |
| 83 ¾ | 40 ½ | TexInstr | TXN | 0.68 | 11 | 5036 | 46 ¾ | +¼ |

Stock quotations are easy to read once you understand the types of information being presented. The first two columns give the trading highs and lows for the year for the stock. We can see that Texas Instruments has traded at a high of 83 3/4 dollars per share on the year and a low of 40 1/2 dollars per share. The fourth column contains the symbol that the exchange uses to identify the company. The fifth column indicates that the current annual dividend rate for TXN is $0.68 per share. If you held 100 shares of TXN stock for a year, you would earn $68.00 in dividends, providing the dividend rate wasn't changed during this period.

The sixth column, PE, represents the Price/Earnings Ratio. Of the various figures listed above, the Price/Earning ratio is the one that is most often confusing. In the quote above, TXN has a Price/Earnings Ratio of 11. This means that the current price of a share of stock is 11 times the earning power of that share. The eighth column gives us the close price on which the Price/Earning ratio is based, here 46 3/4 dollars per share. By dividing the last close by the PE of 11, we can see that TXN is currently earning $4.25 per share.

Columns seven, eight and nine are straightforward. Column seven, Vol 100s, presents the day's trading volume in 100 share units. Here the day's trading for TXN was 503,600 shares. Column eight, Last, presents the closing per share price of the stock based on the final trade of the day. Column nine, Net Chng, presents the advance or loss for the day. Here we can see that TXN is up 1/4 point, or 25 cents per share from the prior day's close. This stock quote illustrates the two most common ways an investor earns money from his investment: Capital Gains and Dividend Income. There are additional ways which we will look at shortly.

Capital gains simply means an increase in the market value of a stock. In the case of TXN, if an investor had been lucky enough to buy at the year's low of 40 1/2, he would now have an unrealized gain of 6 1/4 points, or $6.25 per share with the stock closing at 46 3/4. Of course, if the same investor had bought at the high of 83 3/4, he would now have an unrealized loss of 37 points, or $37.00 per share.

Dividend Income is much more predictable and sedate, and also less exciting. If our investor held 100 shares of TXN of a year, and the dividend rate was not changed, he would have earned $68.00 in dividend income. Generally speaking, dividend payout rates are not nearly as changeable as the price of the stock itself. A steady payout of dividends keeps the shareholders happy, and companies will go to considerable ends to achieve this appearance of steadiness.

Dividend rates are not completely immune to hard times, however. When times are lean the dividend rate may be reduced, or the dividend may be eliminated altogether until the finances of the company improve and there is sufficient cash flow to resume dividend payments.

The seven companies in Big Board provide a realistic cross-section of Capital Gains and Dividend earning potential. A document called a prospectus is available to investors in the case of new issues of stock. The Big Board Prospectus will provide you with key financial information on the seven companies on the Big Board.

Shareholders rarely buy or sell the stocks of publicly traded companies directly to each other, though it is not illegal or impossible to do this. Rather, they deal through a broker. Brokers stay in continual contact with the major exchanges, and thus can almost always find a party willing to buy or sell a particular stock at or near the current trading price range. Brokers charge a fee for this service called a broker's commission. An investor pays a commission when he buys a stock, and pays a commission when he sells.

Making the determination of when and at what price to buy or sell a stock can be a complex matter. This activity is known as Security Analysis, and there are two distinct schools: The Fundamentalists, and The Technicians.

The Fundamentalists advocate close analysis of the basic financial and business health of the companies themselves. From a Fundamentalist perspective, securities analysis would involve close scrutiny of the Company Profile data in the Big Board Prospectus, moderated by consideration of the current broad market trends.

Technical Analysis, on the other hand, almost totally ignores the basic financial profiles of the companies being analyzed, and instead studies the movements of the price indexes themselves in an attempt to discover useful patterns. In Big Board, the player tending to a Technical Analysis viewpoint will be much more interested in the number of squares separating the Market Turns Bear and Fluctuates square from an approaching group of two or three players.

As noted above, Capital Gains and Dividend Income are the two most common ways for an investor to earn money. There are, in addition, other more sophisticated ways to earn, or lose, money.

The Put is a contract to sell 100 shares of stock within a definite time at a definite price. The seller of the Put expects the price to go down and the buyer expects it to go up. For example, if Investor A sells a Put to Investor B for 100 shares of XYZ Corporation at 50 and the stock drops to 25, Investor A simply buys 100 shares at 25 and sells them to Investor B at 50, making $25 per share. However, if the stock goes to 75, Investor A must then sell stock worth $75 per share for $50 per share, thus losing $25 per share. The Call is a similar contract, but the reverse of the Put.

The Margin Call is a hazard sometimes encountered by high flying investors buying stocks with borrowed money.

When an investor buys on margin, he only puts up a portion of the purchase price, and borrows the rest from the broker. This allows the investor to purchase more shares than he would have been able to buy if required to pay fully in cash. The theory behind buying on margin is that it allows the investor to own more shares in a rising market and thus make money faster. The downside of buying on margin is that if the market goes bear, the investor can lose money at the same brisk rate. When the investor's equity falls below a certain percentage, more cash must be put up to satisfy the margin requirements.

Overseeing the action in the various stock exchanges is a Federal oversight group called the Securities Exchange Commission. The Securities Exchange Commission was founded in 1934 largely in response to the speculative excesses that contributed to the Crash of October 1929 and the Great Depression.

The SEC has the general responsibility to ensure that securities markets are run in a fair and equitable manner. The SEC has various tools at its disposal for curbing illegal practices. An SEC investigation often can have an adverse effect on a company's market value.

The concepts covered in this short primer are implemented in various way in Big Board. This description of the general workings of the market and stock exchanges is not intended to replace or modify The Rules of Big Board and the Big Board Regulations. In all cases, the rules and regulations govern the play in Big Board.

BIG BOARD PROSPECTUS

Profiles Of The Big Board Companies

Global Motors: A blue chip stock for decades, Global Motors is a large, mature company with operations throughout the United States and Europe. Its initial valuation of $80 per share is the highest of the seven companies on the Big Board. The two game board fluctuation squares for Global Motors, one moving the stock up four points and the other moving it down two points, give the company a stable, moderately upward capital gains profile. Global Motors pays the highest dividend of the seven companies at $5 per share. There are 1,000 shares of stock available for trading in the original issue. Stock Symbol: GM.

Consolidated Technologies: Consolidated Technologies, with an initial valuation of $70 per share, starts the game second only to Global Motors on the Big Board. Like Global Motors, Consolidated Technologies has an overall moderately upward capital gains profile. However, the game board fluctuation square values of eight points up and six points down, make Consolidated Technologies somewhat more volatile. Consolidated Technologies pay a $3 dividend per share. There are 800 shares of stock available for trading in the original issue. Stock Symbol: CT.

International Airways: A mid-sized international cargo and passenger air carrier, International Airways serves the Western United States and the Pacific Rim. With expanding overseas operations, International Air's fluctuation squares of plus six points and minus two give it a moderately strong capital appreciation potential. International Airways is currently diverting a major portion of cash flow to this expansion, and thus pays a modest dividend of $1 per share. There are 600 shares of stock available for trading in the original issue, at an initial price of $60 per share. Stock Symbol: IA.

United Speculators: A holding company specializing in a variety of highly speculative and volatile investments, United Speculators is probably best described as a mutual fund for the adventurous. The game board fluctuation squares of twenty points up and twenty points down make United Speculators by far the most volatile stock on the Big Board. The Board of Directors of United Speculators have neither the time nor the inclination to deal with anything as mundane as dividend payments. Accordingly, United Speculators doesn't pay a dividend. There are 1,000 shares of stock available for trading in the original issue, at an initial price of $50 per share. Stock Symbol: US.

New York Gas & Electric: Serving Upstate New York since the turn of the century, New York Gas & Electric offers the stability common to utility stocks. The game board fluctuation squares of two points up and two points down in fact make New York Gas & Electric the most inherently stable of the companies on the Big Board. With a steady history of revenue, New York Gas & Electric pays a relatively attractive dividend of $3 per share. There are 800 shares of stock available for trading in the original issue, at an initial price of $40 per share. Stock Symbol: NY.

Solar Power, Inc.: A relatively young company in a new technology, Solar Power develops and markets solar energy collection units throughout the Southwest. Currently diverting all incoming revenues back into research and marketing efforts, Solar Power does not pay a dividend. The game board fluctuation squares of ten points up and four points down nonetheless give Solar Power the attractive capital gains potential of an up and coming growth stock. There are 600 shares of stock available for trading in the original issue, at an initial price of $30 per share. Stock Symbol: SP.

Ralph's Shoes: Solid little company. Established in Green Bay in 1953, Ralph's Shoes retails a range of athletic and dress styles throughout Wisconsin and Minnesota. The game board fluctuation squares of four points up and two points down reflect a slow but steady increase in sales at Ralph's over the last ten years. Paying a dividend of $1 per share, Ralph's Shoes offers balanced capital gains potential and dividend income to the investor. At an initial trading price of $20 per share, Ralph's Shoes is attractively affordable. There are 400 shares of stock available for trading in the original issue. Stock Symbol: RS.

Company Profiles Summary

| | Price per Share at Beginning of Game | Capital Gains Profile | Dividend per 100 Shares | Original Issue Shares |
|---|---|---|---|---|
| Global Motors | $80/share | +4/−2 | $500 | $1,000 |
| Consolidated Technologies | $70/share | +8/−6 | $300 | 800 |
| International Air | $60/share | +6/−2 | $100 | 600 |
| United Speculators | $50/share | +20/−20 | — | 1,000 |
| New York Gas & Electric | $40/share | +2/−2 | $300 | 800 |
| Solar Power, Inc. | $30/share | +10/−4 | — | 600 |
| Ralph's Shoes | $20/share | +4/−2 | $100 | 400 |

Disclaimer: This prospectus is not an advertisement. There is no guarantee that any of the stocks described herein will prove profitable to the investor, nor that any of the companies represented thereby will even survive to the end of the game. The stock of all companies on the Big Board, their respective individual dividend and capital gain profiles notwithstanding, are subject to the influence of broad market swings; bankruptcy; good luck; the use of certain options on the game board which may elevate or depress the value of issues owned by you or an opponent; bad luck; stock splits; malice or goodwill on the part of an opponent; heedless manipulation of companies in which you, innocently, own stock; SEC actions; heedless manipulation of companies that you yourself have instigated, etc., etc.

BIG BOARD

Stock Purchases Table
Net Costs For Stock Purchases Including Commission

| per Shares | 100 Shares | 200 Shares | 300 Shares | 400 Shares | 500 Shares |
|---|---|---|---|---|---|
| 2 | 300 | 600 | 900 | 1,200 | 1,500 |
| 4 | 500 | 1,000 | 1,500 | 2,000 | 2,500 |
| 6 | 700 | 1,400 | 2,100 | 2,800 | 3,500 |
| 8 | 900 | 1,800 | 2,700 | 3,600 | 4,500 |
| 10 | 1,100 | 2,200 | 3,300 | 4,400 | 5,500 |
| 12 | 1,300 | 2,600 | 3,900 | 5,200 | 6,500 |
| 14 | 1,500 | 3,000 | 4,500 | 6,000 | 7,500 |
| 16 | 1,700 | 3,400 | 5,100 | 6,800 | 8,500 |
| 18 | 1,900 | 3,800 | 5,700 | 7,600 | 9,500 |
| 20 | 2,100 | 4,200 | 6,300 | 8,400 | 10,500 |
| 22 | 2,300 | 4,600 | 6,900 | 9,200 | 11,500 |
| 24 | 2,500 | 5,000 | 7,500 | 10,000 | 12,500 |
| 26 | 2,700 | 5,400 | 8,100 | 10,800 | 13,500 |
| 28 | 2,900 | 5,800 | 8,700 | 11,600 | 14,500 |
| 30 | 3,100 | 6,200 | 9,300 | 12,400 | 15,500 |
| 32 | 3,300 | 6,600 | 9,900 | 13,200 | 16,500 |
| 34 | 3,500 | 7,000 | 10,500 | 14,000 | 17,500 |
| 36 | 3,700 | 7,400 | 11,100 | 14,800 | 18,500 |
| 38 | 3,900 | 7,800 | 11,700 | 15,600 | 19,500 |
| 40 | 4,100 | 8,200 | 12,300 | 16,400 | 20,500 |
| 42 | 4,300 | 8,600 | 12,900 | 17,200 | 21,500 |
| 44 | 4,500 | 9,000 | 13,500 | 18,000 | 22,500 |
| 46 | 4,700 | 9,400 | 14,100 | 18,800 | 23,500 |
| 48 | 4,900 | 9,800 | 14,700 | 19,600 | 24,500 |
| 50 | 5,100 | 10,200 | 15,300 | 20,400 | 25,500 |
| 52 | 5,300 | 10,600 | 15,900 | 21,200 | 26,500 |
| 54 | 5,500 | 11,000 | 16,500 | 22,000 | 27,500 |
| 56 | 5,700 | 11,400 | 17,100 | 22,800 | 28,500 |
| 58 | 5,900 | 11,800 | 17,700 | 23,600 | 29,500 |
| 60 | 6,100 | 12,200 | 18,300 | 24,400 | 30,500 |
| 62 | 6,300 | 12,600 | 18,900 | 25,200 | 31,500 |
| 64 | 6,500 | 13,000 | 19,500 | 26,000 | 32,500 |
| 66 | 6,700 | 13,400 | 20,100 | 26,800 | 33,500 |
| 68 | 6,900 | 13,800 | 20,700 | 27,600 | 34,500 |
| 70 | 7,100 | 14,200 | 21,300 | 28,400 | 35,500 |
| 72 | 7,300 | 14,600 | 21,900 | 29,200 | 36,500 |
| 74 | 7,500 | 15,000 | 22,500 | 30,000 | 37,500 |
| 76 | 7,700 | 15,400 | 23,100 | 30,800 | 38,500 |
| 78 | 7,900 | 15,800 | 23,700 | 31,600 | 39,500 |
| 80 | 8,100 | 16,200 | 24,300 | 32,400 | 40,500 |
| 82 | 8,300 | 16,600 | 24,900 | 33,200 | 41,500 |
| 84 | 8,500 | 17,000 | 25,500 | 34,000 | 42,500 |
| 86 | 8,700 | 17,400 | 26,100 | 34,800 | 43,500 |
| 88 | 8,900 | 17,800 | 26,700 | 35,600 | 44,500 |
| 90 | 9,100 | 18,200 | 27,300 | 36,400 | 45,500 |
| 92 | 9,300 | 18,600 | 27,900 | 37,200 | 46,500 |
| 94 | 9,500 | 19,000 | 28,500 | 38,000 | 47,500 |
| 96 | 9,700 | 19,400 | 29,100 | 38,800 | 48,500 |
| 98 | 9,900 | 19,800 | 29,700 | 39,600 | 49,500 |
| 100 | 10,100 | 20,200 | 30,300 | 40,400 | 50,500 |
| per Shares | 600 Shares | 700 Shares | 800 Shares | 900 Shares | 1,000 Shares |
| 2 | 1,800 | 2,100 | 2,400 | 2,700 | 3,000 |
| 4 | 3,000 | 3,500 | 4,000 | 4,500 | 5,000 |
| 6 | 4,200 | 4,900 | 5,600 | 6,300 | 7,000 |
| 8 | 5,400 | 6,300 | 7,200 | 8,100 | 9,000 |
| 10 | 6,600 | 7,700 | 8,800 | 9,900 | 11,000 |
| 12 | 7,800 | 9,100 | 10,400 | 11,700 | 13,000 |
| 14 | 9,000 | 10,500 | 12,000 | 13,500 | 15,000 |
| 16 | 10,200 | 11,900 | 13,600 | 15,300 | 17,000 |
| 18 | 11,400 | 13,300 | 15,200 | 17,100 | 19,000 |
| 20 | 12,600 | 14,700 | 16,800 | 18,900 | 21,000 |
| 22 | 13,800 | 16,100 | 18,400 | 20,700 | 23,000 |
| 24 | 15,000 | 17,500 | 20,000 | 22,500 | 25,000 |
| 26 | 16,200 | 18,900 | 21,600 | 24,300 | 27,000 |
| 28 | 17,400 | 20,300 | 23,200 | 26,100 | 29,000 |
| 30 | 18,600 | 21,700 | 24,800 | 27,900 | 31,000 |

-continued

BIG BOARD

Stock Purchases Table
Net Costs For Stock Purchases Including Commission

| per Shares | 100 Shares | 200 Shares | 300 Shares | 400 Shares | 500 Shares |
|---|---|---|---|---|---|
| 32 | 19,800 | 23,100 | 26,400 | 29,700 | 33,000 |
| 34 | 21,000 | 24,500 | 28,000 | 31,500 | 35,000 |
| 36 | 22,200 | 25,900 | 29,600 | 33,300 | 37,000 |
| 38 | 23,400 | 27,300 | 31,200 | 35,100 | 39,000 |
| 40 | 24,600 | 28,700 | 32,800 | 36,900 | 41,000 |
| 42 | 25,800 | 30,100 | 34,400 | 38,700 | 43,000 |
| 44 | 27,000 | 31,500 | 36,000 | 40,500 | 45,000 |
| 46 | 28,200 | 32,900 | 37,600 | 42,300 | 47,000 |
| 48 | 29,400 | 34,300 | 39,200 | 44,100 | 49,000 |
| 50 | 30,600 | 35,700 | 40,800 | 45,900 | 51,000 |
| 52 | 31,800 | 37,100 | 42,400 | 47,700 | 53,000 |
| 54 | 33,000 | 38,500 | 44,000 | 49,500 | 55,000 |
| 56 | 34,200 | 39,900 | 45,600 | 51,300 | 57,000 |
| 58 | 35,400 | 41,300 | 47,200 | 53,100 | 59,000 |
| 60 | 36,600 | 42,700 | 48,800 | 54,900 | 61,000 |
| 62 | 37,800 | 44,100 | 50,400 | 56,700 | 63,000 |
| 64 | 39,000 | 45,500 | 52,000 | 58,500 | 65,000 |
| 66 | 40,200 | 46,900 | 53,600 | 60,300 | 67,000 |
| 68 | 41,400 | 48,300 | 55,200 | 62,100 | 69,000 |
| 70 | 42,600 | 49,700 | 56,800 | 63,900 | 71,000 |
| 72 | 43,800 | 51,100 | 58,400 | 65,700 | 73,000 |
| 74 | 45,000 | 52,500 | 60,000 | 67,500 | 75,000 |
| 76 | 46,200 | 53,900 | 61,600 | 69,300 | 77,000 |
| 78 | 47,400 | 55,300 | 63,200 | 71,100 | 79,000 |
| 80 | 48,600 | 56,700 | 64,800 | 72,900 | 81,000 |
| 82 | 49,800 | 58,100 | 66,400 | 74,700 | 83,000 |
| 84 | 51,000 | 59,500 | 68,000 | 76,500 | 85,000 |
| 86 | 52,200 | 60,900 | 69,600 | 78,300 | 87,000 |
| 88 | 53,400 | 62,300 | 71,200 | 80,100 | 89,000 |
| 90 | 54,600 | 63,700 | 72,800 | 81,900 | 91,000 |
| 92 | 55,800 | 65,100 | 74,400 | 83,700 | 93,000 |
| 94 | 57,000 | 66,500 | 76,000 | 85,500 | 95,000 |
| 96 | 58,200 | 67,900 | 77,600 | 87,300 | 97,000 |
| 98 | 59,400 | 69,300 | 79,200 | 89,100 | 99,000 |
| 100 | 60,600 | 70,700 | 80,800 | 90,900 | 101,000 |
| per Shares | 1,100 Shares | 1,200 Shares | 1,300 Shares | 1,400 Shares | 1,500 Shares |
| 2 | 3,300 | 3,600 | 3,900 | 4,200 | 4,500 |
| 4 | 5,500 | 6,000 | 6,500 | 7,000 | 7,500 |
| 6 | 7,700 | 8,400 | 9,100 | 9,800 | 10,500 |
| 8 | 9,900 | 10,800 | 11,700 | 12,600 | 13,500 |
| 10 | 12,100 | 13,200 | 14,300 | 15,400 | 16,500 |
| 12 | 14,300 | 15,600 | 16,900 | 18,200 | 19,500 |
| 14 | 16,500 | 18,000 | 19,500 | 21,000 | 22,500 |
| 16 | 18,700 | 20,400 | 22,100 | 23,800 | 25,500 |
| 18 | 20,900 | 22,800 | 24,700 | 26,600 | 28,500 |
| 20 | 23,100 | 25,200 | 27,300 | 29,400 | 31,500 |
| 22 | 25,300 | 27,600 | 29,900 | 32,200 | 34,500 |
| 24 | 27,500 | 30,000 | 32,500 | 35,000 | 37,500 |
| 26 | 29,700 | 32,400 | 35,100 | 37,800 | 40,500 |
| 28 | 31,900 | 34,800 | 37,700 | 40,600 | 43,500 |
| 30 | 34,100 | 37,200 | 40,300 | 43,400 | 46,500 |
| 32 | 36,300 | 39,600 | 42,900 | 46,200 | 49,500 |
| 34 | 38,500 | 42,000 | 45,500 | 49,000 | 52,500 |
| 36 | 40,700 | 44,400 | 48,100 | 51,800 | 55,500 |
| 38 | 42,900 | 46,800 | 50,700 | 54,600 | 58,500 |
| 40 | 45,100 | 49,200 | 53,300 | 57,400 | 61,500 |
| 42 | 47,300 | 51,600 | 55,900 | 60,200 | 64,500 |
| 44 | 49,500 | 54,000 | 58,500 | 63,000 | 67,500 |
| 46 | 51,700 | 56,400 | 61,100 | 65,800 | 70,500 |
| 48 | 53,900 | 58,800 | 63,700 | 68,600 | 73,500 |
| 50 | 56,100 | 61,200 | 66,300 | 71,400 | 76,500 |
| 52 | 58,300 | 63,600 | 68,900 | 74,200 | 79,500 |
| 54 | 60,500 | 66,000 | 71,500 | 77,000 | 82,500 |
| 56 | 62,700 | 68,400 | 74,100 | 79,800 | 85,500 |
| 58 | 64,900 | 70,800 | 76,700 | 82,600 | 88,500 |
| 60 | 67,100 | 73,200 | 79,300 | 85,400 | 91,500 |
| 62 | 69,300 | 75,600 | 81,900 | 88,200 | 94,500 |
| 64 | 71,500 | 78,000 | 84,500 | 91,000 | 97,500 |
| 66 | 73,700 | 80,400 | 87,100 | 93,800 | 100,500 |
| 68 | 75,900 | 82,800 | 89,700 | 96,600 | 103,500 |

-continued

BIG BOARD

Stock Purchases Table
Net Costs For Stock Purchases Including Commission

| per Shares | 100 Shares | 200 Shares | 300 Shares | 400 Shares | 500 Shares |
|---|---|---|---|---|---|
| 70 | 78,100 | 85,200 | 92,300 | 99,400 | 106,500 |
| 72 | 80,300 | 87,600 | 94,900 | 102,200 | 109,500 |
| 74 | 82,500 | 90,000 | 97,500 | 105,000 | 112,500 |
| 76 | 84,700 | 92,400 | 100,100 | 107,800 | 115,500 |
| 78 | 86,900 | 94,800 | 102,700 | 110,600 | 118,500 |
| 80 | 89,100 | 97,200 | 105,300 | 113,400 | 121,500 |
| 82 | 91,300 | 99,600 | 107,900 | 116,200 | 124,500 |
| 84 | 93,500 | 102,000 | 110,500 | 119,000 | 127,500 |
| 86 | 95,700 | 104,400 | 113,100 | 121,800 | 130,500 |
| 88 | 97,900 | 106,800 | 115,700 | 124,600 | 133,500 |
| 90 | 100,100 | 109,200 | 118,300 | 127,400 | 136,500 |
| 92 | 102,300 | 111,600 | 120,900 | 130,200 | 139,500 |
| 94 | 104,500 | 114,000 | 123,500 | 133,000 | 142,500 |
| 96 | 106,700 | 116,400 | 126,100 | 135,800 | 145,500 |
| 98 | 108,900 | 118,800 | 128,700 | 138,600 | 148,500 |
| 100 | 111,100 | 121,200 | 131,300 | 141,400 | 151,500 |
| per Shares | 1,600 Shares | 1,700 Shares | 1,800 Shares | 1,900 Shares | 2,000 Shares |
| 2 | 4,800 | 5,100 | 5,400 | 5,700 | 6,000 |
| 4 | 8,000 | 8,500 | 9,000 | 9,500 | 10,000 |
| 6 | 11,200 | 11,900 | 12,600 | 13,300 | 14,000 |
| 8 | 14,400 | 15,300 | 16,200 | 17,100 | 18,000 |
| 10 | 17,600 | 18,700 | 19,800 | 20,900 | 22,000 |
| 12 | 20,800 | 22,100 | 23,400 | 24,700 | 26,000 |
| 14 | 24,000 | 25,500 | 27,000 | 28,500 | 30,000 |
| 16 | 27,200 | 28,900 | 30,600 | 32,300 | 34,000 |
| 18 | 30,400 | 32,300 | 34,200 | 36,100 | 38,000 |
| 20 | 33,600 | 35,700 | 37,800 | 39,900 | 42,000 |
| 22 | 36,800 | 39,100 | 41,400 | 43,700 | 46,000 |
| 24 | 40,000 | 42,500 | 45,000 | 47,500 | 50,000 |
| 26 | 43,200 | 45,900 | 48,600 | 51,300 | 54,000 |
| 28 | 46,400 | 49,300 | 52,200 | 55,100 | 58,000 |
| 30 | 49,600 | 52,700 | 55,800 | 58,900 | 62,000 |
| 32 | 52,800 | 56,100 | 59,400 | 62,700 | 66,000 |
| 34 | 56,000 | 59,500 | 63,000 | 66,500 | 70,000 |
| 36 | 59,200 | 62,900 | 66,600 | 70,300 | 74,000 |
| 38 | 62,400 | 66,300 | 70,200 | 74,100 | 78,000 |
| 40 | 65,600 | 69,700 | 73,800 | 77,900 | 82,000 |
| 42 | 68,800 | 73,100 | 77,400 | 81,700 | 86,000 |
| 44 | 72,000 | 76,500 | 81,000 | 85,500 | 90,000 |
| 46 | 75,200 | 79,900 | 84,600 | 89,300 | 94,000 |
| 48 | 78,400 | 83,300 | 88,200 | 93,100 | 98,000 |
| 50 | 81,600 | 86,700 | 91,800 | 96,900 | 102,000 |
| 52 | 84,800 | 90,100 | 95,400 | 100,700 | 106,000 |
| 54 | 88,000 | 93,500 | 99,000 | 104,500 | 110,000 |
| 56 | 91,200 | 96,900 | 102,600 | 108,300 | 114,000 |
| 58 | 94,400 | 100,300 | 106,200 | 112,100 | 118,000 |
| 60 | 97,600 | 103,700 | 109,800 | 115,900 | 122,000 |
| 62 | 100,800 | 107,100 | 113,400 | 119,700 | 126,000 |
| 64 | 104,000 | 110,500 | 117,000 | 123,500 | 130,000 |
| 66 | 107,200 | 113,900 | 120,600 | 127,300 | 134,000 |
| 68 | 110,400 | 117,300 | 124,200 | 132,100 | 138,000 |
| 70 | 113,600 | 120,700 | 127,800 | 134,900 | 142,000 |
| 72 | 116,800 | 124,100 | 131,400 | 138,700 | 146,000 |
| 74 | 120,000 | 127,500 | 135,000 | 142,500 | 150,000 |
| 76 | 123,200 | 130,900 | 138,600 | 146,300 | 154,000 |
| 78 | 126,400 | 134,300 | 142,200 | 150,100 | 158,000 |
| 80 | 129,600 | 137,700 | 145,800 | 153,900 | 162,000 |
| 82 | 132,800 | 141,100 | 149,400 | 157,700 | 166,000 |
| 84 | 136,000 | 144,500 | 153,000 | 161,500 | 170,000 |
| 86 | 139,200 | 147,900 | 156,600 | 165,300 | 174,000 |
| 88 | 142,400 | 151,300 | 160,200 | 169,100 | 178,000 |
| 90 | 145,600 | 157,700 | 163,800 | 172,900 | 182,000 |
| 92 | 148,800 | 158,100 | 167,400 | 176,700 | 186,000 |
| 94 | 152,000 | 161,500 | 171,000 | 180,500 | 190,000 |
| 96 | 155,200 | 164,900 | 174,600 | 184,300 | 194,000 |
| 98 | 158,400 | 168,300 | 178,200 | 188,100 | 198,000 |
| 100 | 161,600 | 171,700 | 181,800 | 191,900 | 202,000 |

BIG BOARD
Stock Sales Table
Net Proceeds From Stock Sales After Commission

| per Shares | 100 Shares | 200 Shares | 300 Shares | 400 Shares | 500 Shares |
|---|---|---|---|---|---|
| 2 | 100 | 200 | 300 | 400 | 500 |
| 4 | 300 | 600 | 900 | 1,200 | 1,500 |
| 6 | 500 | 1,000 | 1,500 | 2,000 | 2,500 |
| 8 | 700 | 1,400 | 2,100 | 2,800 | 3,500 |
| 10 | 900 | 1,800 | 2,700 | 3,600 | 4,500 |
| 12 | 1,100 | 2,200 | 3,300 | 4,400 | 5,500 |
| 14 | 1,300 | 2,600 | 3,900 | 5,200 | 6,500 |
| 16 | 1,500 | 3,000 | 4,500 | 6,000 | 7,500 |
| 18 | 1,700 | 3,400 | 5,100 | 6,800 | 8,500 |
| 20 | 1,900 | 3,800 | 5,700 | 7,600 | 9,500 |
| 22 | 2,100 | 4,200 | 6,300 | 8,400 | 10,500 |
| 24 | 2,300 | 4,600 | 6,900 | 9,200 | 11,500 |
| 26 | 2,500 | 5,000 | 7,500 | 10,000 | 12,500 |
| 28 | 2,700 | 5,400 | 8,100 | 10,800 | 13,500 |
| 30 | 2,900 | 5,800 | 8,700 | 11,600 | 14,500 |
| 32 | 3,100 | 6,200 | 9,300 | 12,400 | 15,500 |
| 34 | 3,300 | 6,600 | 9,900 | 13,200 | 16,500 |
| 36 | 3,500 | 7,000 | 10,500 | 14,000 | 17,500 |
| 38 | 3,700 | 7,400 | 11,100 | 14,800 | 18,500 |
| 40 | 3,900 | 7,800 | 11,700 | 15,600 | 19,500 |
| 42 | 4,100 | 8,200 | 12,300 | 16,400 | 20,500 |
| 44 | 4,300 | 8,600 | 12,900 | 17,200 | 21,500 |
| 46 | 4,500 | 9,000 | 13,500 | 18,000 | 22,500 |
| 48 | 4,700 | 9,400 | 14,100 | 18,800 | 23,500 |
| 50 | 4,900 | 9,800 | 14,700. | 19,600 | 24,500 |
| 52 | 5,100 | 10,200 | 15,300 | 20,400 | 25,500 |
| 54 | 5,300 | 10,600 | 15,900 | 21,200 | 26,500 |
| 56 | 5,500 | 11,000 | 16,500 | 22,000 | 27,500 |
| 58 | 5,700 | 11,400 | 17,100 | 22,800 | 28,500 |
| 60 | 5,900 | 11,800 | 17,700 | 23,600 | 29,500 |
| 62 | 6,100 | 12,200 | 18,300 | 24,400 | 30,500 |
| 64 | 6,300 | 12,600 | 18,900 | 25,200 | 31,500 |
| 66 | 6,500 | 13,000 | 19,500 | 26,000 | 32,500 |
| 68 | 6,700 | 13,400 | 20,100 | 26,800 | 33,500 |
| 70 | 6,900 | 13,800 | 20,700 | 27,600 | 34,500 |
| 72 | 7,100 | 14,200 | 21,300 | 28,400 | 35,500 |
| 74 | 7,300 | 14,600 | 21,900 | 29,200 | 36,500 |
| 76 | 7,500 | 15,000 | 22,500 | 30,000 | 37,500 |
| 78 | 7,700 | 15,400 | 23,100 | 30,800 | 38,500 |
| 80 | 7,900 | 15,800 | 23,700 | 31,600 | 39,500 |
| 82 | 8,100 | 16,200 | 24,300 | 32,400 | 40,500 |
| 84 | 8,300 | 16,600 | 24,900 | 33,200 | 41,500 |
| 86 | 8,500 | 17,000 | 25,500 | 34,000 | 42,500 |
| 88 | 8,700 | 17,400 | 26,100 | 34,800 | 43,500 |
| 90 | 8,900 | 17,800 | 26,700 | 35,600 | 44,500 |
| 92 | 9,100 | 18,200 | 27,300 | 36,400 | 45,500 |
| 94 | 9,300 | 18,600 | 27,900 | 37,200 | 46,500 |
| 96 | 9,500 | 19,000 | 28,500 | 38,000 | 47,500 |
| 98 | 9,700 | 19,400 | 29,100 | 38,800 | 48,500 |
| 100 | 9,900 | 19,800 | 29,700 | 39,600 | 49,500 |
| per Shares | 600 Shares | 700 Shares | 800 Shares | 900 Shares | 1,000 Shares |
| 2 | 600 | 700 | 800 | 900 | 1,000 |
| 4 | 1,800 | 2,100 | 2,400 | 2,700 | 3,000 |
| 6 | 3,000 | 3,500 | 4,000 | 4,500 | 5,000 |
| 8 | 4,200 | 4,900 | 5,600 | 6,300 | 7,000 |
| 10 | 5,400 | 6,300 | 7,200 | 8,100 | 9,000 |
| 12 | 6,600 | 7,700 | 8,800 | 9,900 | 11,000 |
| 14 | 7,800 | 9,100 | 10,400 | 11,700 | 13,000 |
| 16 | 9,000 | 10,500 | 12,000 | 13,500 | 15,000 |
| 18 | 10,200 | 11,900 | 13,600 | 15,300 | 17,000 |
| 20 | 11,400 | 13,300 | 15,200 | 17,100 | 19,000 |
| 22 | 12,600 | 14,700 | 16,800 | 18,900 | 21,000 |
| 24 | 13,800 | 16,100 | 18,400 | 20,700 | 23,000 |
| 26 | 15,000 | 17,500 | 20,000 | 22,500 | 25,000 |
| 28 | 16,200 | 18,900 | 21,600 | 24,300 | 27,000 |
| 30 | 17,400 | 20,300 | 23,200 | 26,100 | 29,000 |
| 32 | 18,600 | 21,700 | 24,800 | 27,900 | 31,000 |
| 34 | 19,800 | 23,100 | 26,400 | 29,700 | 33,000 |
| 36 | 21,000 | 24,500 | 28,000 | 31,500 | 35,000 |
| 38 | 22,200 | 25,900 | 29,600 | 33,300 | 37,000 |
| 40 | 23,400 | 27,300 | 31,200 | 35,100 | 39,000 |

| | | | | | |
|---|---|---|---|---|---|
| 42 | 24,600 | 28,700 | 32,800 | 36,900 | 41,000 |
| 44 | 25,800 | 30,100 | 34,400 | 38,700 | 43,000 |
| 46 | 27,000 | 31,500 | 36,000 | 40,500 | 45,000 |
| 48 | 28,200 | 32,900 | 37,600 | 42,300 | 47,000 |
| 50 | 29,400 | 34,300 | 39,200 | 44,100 | 49,000 |
| 52 | 30,600 | 35,700 | 40,800 | 45,900 | 51,000 |
| 54 | 31,800 | 37,100 | 42,400 | 47,700 | 53,000 |
| 56 | 33,000 | 38,500 | 44,000 | 49,500 | 55,000 |
| 58 | 34,200 | 39,900 | 45,600 | 51,300 | 57,000 |
| 60 | 35,400 | 41,300 | 47,200 | 53,100 | 59,000 |
| 62 | 36,600 | 42,700 | 48,800 | 54,900 | 61,000 |
| 64 | 37,800 | 44,100 | 50,400 | 56,700 | 63,000 |
| 66 | 39,000 | 45,500 | 52,000 | 58,500 | 65,000 |
| 68 | 40,200 | 46,900 | 53,600 | 60,300 | 67,000 |
| 70 | 41,400 | 48,300 | 55,200 | 62,100 | 69,000 |
| 72 | 42,600 | 49,700 | 56,800 | 63,900 | 71,000 |
| 74 | 43,800 | 51,100 | 58,400 | 65,700 | 73,000 |
| 76 | 45,000 | 52,500 | 60,000 | 67,500 | 75,000 |
| 78 | 46,200 | 53,900 | 61,600 | 69,300 | 77,000 |
| 80 | 47,400 | 55,300 | 63,200 | 71,100 | 79,000 |
| 82 | 48,600 | 56,700 | 64,800 | 72,900 | 81,000 |
| 84 | 49,800 | 58,100 | 66,400 | 74,700 | 83,000 |
| 86 | 51,000 | 59,500 | 68,000 | 76,500 | 85,000 |
| 88 | 52,200 | 60,900 | 69,600 | 78,300 | 87,000 |
| 90 | 53,400 | 62,300 | 71,200 | 80,100 | 89,000 |
| 92 | 54,600 | 63,700 | 72,800 | 81,900 | 91,000 |
| 94 | 55,800 | 65,100 | 74,400 | 83,700 | 93,000 |
| 96 | 57,000 | 66,500 | 76,000 | 85,500 | 95,000 |
| 98 | 58,200 | 67,900 | 77,600 | 87,300 | 97,000 |
| 100 | 59,400 | 69,300 | 79,200 | 89,100 | 99,000 |

| per Shares | 1,100 Shares | 1,200 Shares | 1,300 Shares | 1,400 Shares | 1,500 Shares |
|---|---|---|---|---|---|
| 2 | 1,100 | 1,200 | 1,300 | 1,400 | 1,500 |
| 4 | 3,300 | 3,600 | 3,900 | 4,200 | 4,500 |
| 6 | 5,500 | 6,000 | 6,500 | 7,000 | 7,500 |
| 8 | 7,700 | 8,400 | 9,100 | 9,800 | 10,500 |
| 10 | 9,900 | 10,800 | 11,700 | 12,600 | 13,500 |
| 12 | 12,100 | 13,200 | 14,300 | 15,400 | 16,500 |
| 14 | 14,300 | 15,600 | 16,900 | 18,200 | 19,500 |
| 16 | 16,500 | 18,000 | 19,500 | 21,000 | 22,500 |
| 18 | 18,700 | 20,400 | 22,100 | 23,800 | 25,500 |
| 20 | 20,900 | 22,800 | 24,700 | 26,600 | 28,500 |
| 22 | 23,100 | 25,200 | 27,300 | 29,400 | 31,500 |
| 24 | 25,300 | 27,600 | 29,900 | 32,200 | 34,500 |
| 26 | 27,500 | 30,000 | 32,500 | 35,500 | 37,500 |
| 28 | 29,700 | 32,400 | 35,100 | 37,800 | 40,500 |
| 30 | 31,900 | 34,800 | 37,700 | 40,600 | 43,500 |
| 32 | 34,100 | 37,200 | 40,300 | 43,400 | 46,500 |
| 34 | 36,300 | 39,600 | 42,900 | 46,200 | 49,500 |
| 36 | 38,500 | 42,000 | 45,500 | 49,000 | 52,500 |
| 38 | 40,700 | 44,400 | 48,100 | 51,800 | 55,500 |
| 40 | 42,900 | 48,600 | 50,700 | 54,600 | 58,500 |
| 42 | 45,100 | 49,200 | 53,300 | 57,400 | 61,500 |
| 44 | 47,300 | 51,600 | 55,900 | 60,200 | 64,500 |
| 46 | 49,500 | 54,000 | 58,500 | 63,000 | 67,500 |
| 48 | 51,700 | 56,400 | 61,100 | 65,800 | 70,500 |
| 50 | 53,900 | 58,800 | 63,700 | 68,600 | 73,500 |
| 52 | 56,100 | 61,200 | 66,300 | 71,400 | 76,500 |
| 54 | 58,300 | 63,600 | 68,900 | 74,200 | 79,500 |
| 56 | 60,500 | 66,000 | 71,500 | 77,000 | 82,500 |
| 58 | 62,700 | 68,400 | 74,100 | 79,800 | 85,500 |
| 60 | 64,900 | 70,800 | 76,700 | 81,600 | 88,500 |
| 62 | 67,100 | 73,200 | 79,300 | 85,400 | 91,500 |
| 64 | 69,300 | 75,600 | 81,900 | 88,200 | 94,500 |
| 66 | 71,500 | 78,000 | 84,500 | 91,000 | 97,500 |
| 68 | 73,700 | 80,400 | 87,100 | 93,800 | 100,500 |
| 70 | 75,900 | 82,800 | 89,700 | 96,600 | 103,500 |
| 72 | 78,100 | 85,200 | 92,300 | 99,400 | 106,500 |
| 74 | 80,300 | 87,600 | 94,900 | 102,200 | 109,500 |
| 76 | 82,500 | 90,000 | 97,500 | 105,000 | 112,500 |
| 78 | 84,700 | 92,400 | 100,100 | 107,800 | 115,500 |
| 80 | 86,900 | 94,800 | 102,700 | 110,600 | 118,500 |
| 82 | 89,100 | 97,200 | 105,300 | 113,400 | 121,500 |
| 84 | 91,300 | 99,600 | 107,900 | 116,200 | 124,500 |
| 86 | 93,500 | 102,000 | 110,500 | 119,000 | 127,500 |
| 88 | 95,700 | 104,400 | 113,100 | 121,800 | 130,500 |
| 90 | 97,900 | 106,800 | 115,700 | 124,600 | 133,500 |
| 92 | 100,100 | 109,200 | 118,300 | 127,400 | 136,500 |
| 94 | 102,300 | 111,600 | 120,900 | 130,200 | 139,500 |
| 96 | 104,500 | 114,000 | 123,500 | 133,000 | 142,500 |
| 98 | 106,700 | 116,400 | 126,100 | 135,800 | 145,500 |
| 100 | 108,900 | 118,800 | 128,700 | 138,600 | 148,500 |

| per Shares | 1,600 Shares | 1,700 Shares | 1,800 Shares | 1,900 Shares | 2,000 Shares |
|---|---|---|---|---|---|
| 2 | 1,600 | 1,700 | 1,800 | 1,900 | 2,000 |
| 4 | 4,800 | 5,100 | 5,400 | 5,700 | 6,000 |
| 6 | 8,000 | 8,500 | 9,000 | 9,500 | 10,000 |
| 8 | 11,200 | 11,900 | 12,600 | 13,300 | 14,000 |
| 10 | 14,400 | 15,300 | 16,200 | 17,100 | 18,000 |
| 12 | 17,600 | 18,700 | 19,800 | 20,900 | 22,000 |
| 14 | 20,800 | 22,100 | 23,400 | 24,700 | 26,000 |
| 16 | 24,000 | 25,500 | 27,000 | 28,500 | 30,000 |
| 18 | 27,200 | 28,900 | 30,600 | 32,300 | 34,000 |
| 20 | 30,400 | 32,300 | 34,200 | 36,100 | 38,000 |
| 22 | 33,600 | 35,700 | 37,800 | 39,900 | 42,000 |
| 24 | 36,800 | 39,100 | 41,400 | 43,700 | 46,000 |
| 26 | 40,000 | 42,500 | 45,000 | 47,500 | 50,000 |
| 28 | 43,200 | 45,900 | 48,600 | 51,300 | 54,000 |
| 30 | 46,400 | 49,300 | 52,200 | 55,100 | 58,000 |
| 32 | 49,600 | 52,700 | 55,800 | 58,900 | 62,000 |
| 34 | 52,800 | 56,100 | 59,400 | 62,700 | 66,000 |
| 36 | 56,000 | 59,500 | 63,000 | 66,500 | 70,060 |
| 38 | 59,200 | 62,900 | 66,600 | 70,300 | 74,000 |
| 40 | 62,400 | 66,300 | 70,200 | 74,100 | 78,000 |
| 42 | 65,60.0 | 69,700 | 73,800 | 77,900 | 82,000 |
| 44 | 68,800 | 73,100 | 77,400 | 81,700 | 86,000 |
| 46 | 72,000 | 76,500 | 81,000 | 85,500 | 90,000 |
| 48 | 75,200 | 79,900 | 84,600 | 89,300 | 94,000 |
| 50 | 78,400 | 83,300 | 88,200 | 93,100 | 98,000 |
| 52 | 81,600 | 86,700 | 91,800 | 96,900 | 102,000 |
| 54 | 84,800 | 90,100 | 95,400 | 100,700 | 106,000 |
| 56 | 88,000 | 93,500 | 99,000 | 104,500 | 110,000 |
| 58 | 91,200 | 96,900 | 102,600 | 108,300 | 114,000 |
| 60 | 94,400 | 100,300 | 106,200 | 112,100 | 118,000 |
| 62 | 97,600 | 103,700 | 109,800 | 115,900 | 122,000 |
| 64 | 100,800 | 107,100 | 113,400 | 119,700 | 126,000 |
| 66 | 104,000 | 110,500 | 117,000 | 123,500 | 130,000 |
| 68 | 107,200 | 113,900 | 120,600 | 127,300 | 134,000 |
| 70 | 110,400 | 117,300 | 124,200 | 131,100 | 138,000 |
| 72 | 113,600 | 120,700 | 127,800 | 134,900 | 142,000 |
| 74 | 116,800 | 124,100 | 131,400 | 138,700 | 146,000 |
| 76 | 120,000 | 127,500 | 135,000 | 142,500 | 150,000 |
| 78 | 123,200 | 130,900 | 138,600 | 146,300 | 154,000 |
| 80 | 126,400 | 134,300 | 142,200 | 150,100 | 158,000 |
| 82 | 129,600 | 137,700 | 145,800 | 153,900 | 162,000 |
| 84 | 132,800 | 141,100 | 149,400 | 157,700 | 166,000 |
| 86 | 136,000 | 144,500 | 153,000 | 161,500 | 170,000 |
| 88 | 139,200 | 147,900 | 156,600 | 165,300 | 174,000 |
| 90 | 142,400 | 151,300 | 160,200 | 169,100 | 178,000 |
| 92 | 145,600 | 154,700 | 163,800 | 172,900 | 182,000 |
| 94 | 148,800 | 158,100 | 167,400 | 176,700 | 186,000 |
| 96 | 152,000 | 161,500 | 171,000 | 180,500 | 190,000 |
| 98 | 155,200 | 164,900 | 174,600 | 184,300 | 194,000 |
| 100 | 158,400 | 168,300 | 178,200 | 188,100 | 198,000 |

BIG BOARD
Dividend Payout And Yield Tables
Dividend Payout Table

| # of Dividend Rate Per 100 Shares | | | | # of Dividend Rate Per 100 Shares | | | |
|---|---|---|---|---|---|---|---|
| Shares | 100 | 300 | 500 | Shares | 100 | 300 | 500 |
| 100 | 100 | 300 | 500 | 5,100 | 5,100 | 15,300 | 25,500 |
| 200 | 200 | 600 | 1,000 | 5,200 | 5,200 | 15,600 | 26,000 |
| 300 | 300 | 900 | 1,500 | 5,300 | 5,300 | 15,900 | 26,500 |
| 400 | 400 | 1,200 | 2,000 | 5,400 | 5,400 | 16,200 | 27,000 |
| 500 | 500 | 1,500 | 2,500 | 5,500 | 5,500 | 16,500 | 27,500 |
| 600 | 600 | 1,800 | 3,000 | 5,600 | 5,600 | 16,800 | 28,000 |
| 700 | 700 | 2,100 | 3,500 | 5,700 | 5,700 | 17,100 | 28,500 |
| 800 | 800 | 2,400 | 4,000 | 5,800 | 5,800 | 17,400 | 29,000 |
| 900 | 900 | 2,700 | 4,500 | 5,900 | 5,900 | 17,700 | 29,500 |
| 1,000 | 1,000 | 3,000 | 5,000 | 6,000 | 6,000 | 18,000 | 30,000 |
| 1,100 | 1,100 | 3,300 | 5,500 | 6,100 | 6,100 | 18,300 | 30,500 |
| 1,200 | 1,200 | 3,600 | 6,000 | 6,200 | 6,200 | 18,600 | 31,000 |
| 1,300 | 1,300 | 3,900 | 6,500 | 6,300 | 6,300 | 18,900 | 31,500 |
| 1,400 | 1,400 | 4,200 | 7,000 | 6,400 | 6,400 | 19,200 | 32,000 |

-continued

BIG BOARD
Dividend Payout And Yield Tables
Dividend Payout Table

| # of Dividend Rate Per 100 Shares | | | | # of Dividend Rate Per 100 Shares | | | |
|---|---|---|---|---|---|---|---|
| Shares | 100 | 300 | 500 | Shares | 100 | 300 | 500 |
| 1,500 | 1,500 | 4,500 | 7,500 | 6,500 | 6,500 | 19,500 | 32,500 |
| 1,600 | 1,600 | 4,800 | 8,000 | 6,600 | 6,600 | 19,800 | 33,000 |
| 1,700 | 1,700 | 5,100 | 8,500 | 6,700 | 6,700 | 20,100 | 33,500 |
| 1,800 | 1,800 | 5,400 | 9,000 | 6,80 | 6,800 | 20,400 | 34,000 |
| 1,900 | 1,900 | 5,700 | 9,500 | 6,900 | 6,900 | 20,700 | 34,500 |
| 2,000 | 2,000 | 6,000 | 10,000 | 7,000 | 7,000 | 21,000 | 35,000 |
| 2,100 | 2,100 | 6,300 | 10,500 | 7,100 | 7,100 | 21,300 | 35,500 |
| 2,200 | 2,200 | 6,600 | 11,000 | 7,200 | 7,200 | 21,600 | 36,000 |
| 2,300 | 2,300 | 6,900 | 11,500 | 7,300 | 7,300 | 21,900 | 36,500 |
| 2,400 | 2,400 | 7,200 | 12,000 | 7,400 | 7,400 | 22,200 | 37,000 |
| 2,500 | 2,500 | 7,500 | 12,500 | 7,500 | 7,500 | 22,500 | 37,500 |
| 2,600 | 2,600 | 7,800 | 13,000 | 7,600 | 7,600 | 22,800 | 38,000 |
| 2,700 | 2,700 | 8,100 | 13,500 | 7,700 | 7,000 | 23,100 | 38,500 |
| 2,800 | 2,800 | 8,400 | 14,000 | 7,800 | 7,800 | 23,400 | 39,000 |
| 2,900 | 2,900 | 8,700 | 14,500 | 7,900 | 7,900 | 23,700 | 39,500 |
| 3,000 | 3,000 | 9,000 | 15,000 | 8,000 | 8,000 | 24,000 | 40,000 |
| 3,100 | 3,100 | 9,300 | 15,500 | 8,100 | 8,100 | 24,300 | 40,500 |
| 3,200 | 3,200 | 9,600 | 16,000 | 8,200 | 8,200 | 24,600 | 41,000 |
| 3,300 | 3,300 | 9,900 | 16,500 | 8,300 | 8,300 | 24,900 | 41,500 |
| 3,400 | 3,400 | 10,200 | 17,000 | 8,400 | 8,400 | 25,200 | 42,000 |
| 3,500 | 3,500 | 10,500 | 17,500 | 8,500 | 8,500 | 25,500 | 42,500 |
| 3,600 | 3,600 | 10,800 | 18,000 | 8,600 | 8,600 | 25,800 | 43,000 |
| 3,700 | 3,700 | 11,100 | 18,500 | 8,700 | 8,700 | 26,100 | 43,500 |
| 3,800 | 3,800 | 11,400 | 19,000 | 8,800 | 8,800 | 26,400 | 44,000 |
| 3,900 | 3,900 | 11,700 | 19,500 | 8,900 | 8,900 | 26,700 | 44,500 |
| 4,000 | 4,000 | 12,000 | 20,000 | 9,000 | 9,000 | 27,000 | 45,000 |
| 4,100 | 4,100 | 12,300 | 20,500 | 9,100 | 9,100 | 27,300 | 45,500 |
| 4,200 | 4,200 | 12,600 | 21,000 | 9,200 | 0,200 | 27,600 | 46,000 |
| 4,300 | 4,300 | 12,900 | 21,500 | 9,300 | 9,300 | 27,900 | 46,500 |
| 4,400 | 4,400 | 13,200 | 22,000 | 9,400 | 90,400 | 28,200 | 47,000 |
| 4,500 | 4,500 | 13,500 | 2,500 | 9,500 | 9,500 | 28,500 | 47,500 |
| 4,600 | 4,600 | 13,800 | 23,000 | 9,600 | 9,600 | 28,800 | 48,000 |
| 4,700 | 4,700 | 14,100 | 23,500 | 9,700 | 9,700 | 29,100 | 48,500 |
| 4,800 | 4,800 | 14,400 | 24,000 | 9,800 | 9,800 | 29,400 | 49,000 |
| 4,900 | 4,900 | 14,700 | 24,500 | 9,900 | 9,900 | 29,700 | 49,500 |
| 5,000 | 5,000 | 15,000 | 25,000 | 10,000 | 10,000 | 30,000 | 50,000 |

Dividend Yield Table

| Per Share | Dividend Rate Per Share | | | Per Share | Dividend Rate Per Share | | |
|---|---|---|---|---|---|---|---|
| Value | $1 | $3 | $5 | Value | $1 | $3 | $5 |
| $1 | (No dividends paid | | | $51 | 2.0% | 5.9% | 9.8% |
| $2 | on stock with | | | $52 | 1.9% | 5.8% | 9.6% |
| $3 | market value of | | | $53 | 1.9% | 5.7% | 9.4% |
| $4 | less than 10) | | | $54 | 1.9% | 5.6% | 9.3% |
| $5 | | | | $55 | 1.8% | 5.5% | 9.1% |
| $6 | | | | $56 | 1.8% | 5.4% | 8.9% |
| $7 | | | | $57 | 1.8% | 5.3% | 8.8% |
| $8 | | | | $58 | 1.7% | 5.2% | 8.6% |
| $9 | | | | $59 | 1.7% | 5.1% | 8.5% |
| $10 | 10.0% | 30.0% | 50.0% | $60 | 1.7% | 5.0% | 8.3% |
| $11 | 9.1% | 27.3% | 45.5% | $61 | 1.6% | 4.9% | 8.2% |
| $12 | 8.3% | 20.5% | 41.7% | $62 | 1.6% | 4.8%. | 8.1% |
| $13 | 7.7% | 23.1% | 38.5% | $63 | 1.6% | 4.8% | 7.9% |
| $14 | 7.1% | 21.4% | 35.7% | $64 | 1.6% | 4.7% | 7.8% |
| $15 | 6.7%. | 20.0% | 33.3% | $65 | 1.5% | 4.6% | 7.7% |
| $16 | 6.3% | 18.8% | 31.3% | $66 | 1.5% | 4.5% | 7.6% |
| $17 | 5.9% | 17.6% | 29.4% | $67 | 1.5% | 4.5% | 7.5% |
| $18 | 5.6% | 16.7% | 27.8% | $68 | 1.5% | 4.4% | 7.4% |
| $19 | 5.3% | 15.8% | 26.3% | $69 | 1.4% | 4.3% | 7.2% |
| $20 | 5.0% | 15.0% | 25.0% | $70 | 1.4% | 4.3% | 7.1% |
| $21 | 4.8% | 14.3% | 23.8% | $71 | 1.4% | 4.2% | 7.0% |
| $22 | 4.5% | 13.6% | 22.7% | $72 | 1.4% | 4.2% | 6.9% |
| $23 | 4.3% | 13.0% | 21.7% | $73 | 1.4% | 4.1% | 6.8% |
| $24 | 4.2% | 12.5% | 20.8% | $74 | 1.4% | 4.1% | 6.8% |
| $25 | 4.0% | 12.0% | 20.0% | $75 | 1.3% | 4.0% | 6.7% |

-continued

Dividend Yield Table

| Per Share | Dividend Rate Per Share | | | Per Share | Dividend Rate Per Share | | |
|---|---|---|---|---|---|---|---|
| Value | $1 | $3 | $5 | Value | $1 | $3 | $5 |
| $26 | 3.8% | 11.5% | 19.2% | $76 | 1.3% | 3.9% | 6.6% |
| $27 | 3.7% | 11.1% | 18.5% | $77 | 1.3% | 3.9% | 6.5% |
| $28 | 3.6% | 10.7% | 17.9% | $78 | 1.3% | 3.8% | 6.4% |
| $29 | 3.4% | 10.3% | 17.2% | $79 | 1.3% | 3.8% | 6.3% |
| $30 | 3.3% | 10.0% | 16.7% | $80 | 1.3% | 3.8% | 6.3% |
| $31 | 3.2% | 9.7% | 16.1% | $81 | 1.2% | 3.7% | 6.2% |
| $32 | 3.1% | 9.4% | 15.6% | $82 | 1.2% | 3.7.% | 6.1% |
| $33 | 3.0% | 9.1% | 15.2% | $83 | 1.2% | 3.6% | 6.0% |
| $34 | 2.9% | 8.8% | 14.7% | $84 | 1.2% | 3.6% | 6.0% |
| $35 | 2.9% | 8.6% | 14.3% | $85 | 1.2% | 3.5% | 5.9% |
| $36 | 2.8% | 8.3% | 13.9% | $86 | 1.2% | 3.5% | 5.8% |
| $37 | 2.7% | 8.1% | 13.5% | $87 | 1.1% | 3.4% | 5.7% |
| $38 | 2.6% | 7.9% | 13.2% | $88 | 1.1% | 3.4% | 5.7% |
| $39 | 2.6% | 7.7% | 12.8% | $89 | 1.1% | 3.4% | 5.6% |
| $40 | 2.5% | 7.5% | 12.5% | $90 | 1.1% | 3.3% | 5.6% |
| $41 | 2.4% | 7.3% | 12.2% | $91 | 1.1% | 3.3% | 5.5% |
| $42 | 2.4% | 7.1% | 11.9% | $92 | 1.1% | 3.3% | 5.4% |
| $43 | 2.3% | 7.0% | 11.6% | $93 | 1.1% | 3.2% | 5.4% |
| $44 | 2.3% | 6.8% | 11.4% | $94 | 1.1% | 3.2% | 5.3% |
| $45 | 2.2% | 6.7% | 11.1% | $95 | 1.1% | 3.2% | 5.3% |
| $46 | 2.2% | 6.5% | 10.9% | $96 | 1.0% | 3.1% | 5.2% |
| $47 | 2.1% | 6.4% | 10.6% | $97 | 1.0% | 3.1% | 5.2% |
| $48 | 2.1% | 6.3% | 10.4% | $98 | 1.0% | 3.1% | 5.1% |
| $49 | 2.0% | 6.1% | 10.2% | $99 | 1.0% | 3.0% | 5.1% |
| $50 | 2.0% | 6.0% | 10.0% | $100 | 1.0% | 3.0% | 5.0% |

It will be understood that each of the elements described above, or two or more together may also find a useful application in other types of methods differing from the type described above.

While certain novel features of this invention have been shown and described as pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A stock market big board game comprising:

a) a game board having a continuous path around its perimeter divided into consecutive spaces bearing instructions for price fluctuations of individual companies and the market as a whole, market manipulation card purchase options, penalties, bonuses for stock diversification, move anywhere options, puts and calls, market trend changes, and stock price move options, with each of said spaces defining a playing position;

b) a big board;

c) means for mounting said big board vertically to said game board;

d) a plurality of price marker pegs for said big board, to indicate on said big board the activities of seven types of stocks purchased, such as stock prices and splits;

e) a plurality of playing pieces, one for each of the game players, said playing pieces being of a size to fit within said playing positions;

f) play money of different denominations for distribution of part thereof to each player;

g) a random number generating means for designating a number of spaces on said game board to be moved by each said playing piece;

h) a market trend indication piece having a bull head on one side and a bear head on an opposite side;

i) a deck of market manipulation cards;

j) a deck of market fluctuation cards;

k) a plurality of stock certificates; and l) a plurality of certificates of deposit.

2. A stock market big board game as recited in claim 1, further including:

a) a rules for big board pamphlet;

b) a big board regulations pamphlet;

c) a stock market primer pamphlet;

d) a big board prospectus pamphlet;

e) a stock purchases table pamphlet;

f) a stock sales table pamphlet; and g) a dividend payout and yield tables pamphlet.

3. A stock market big board game as recited in claim 1, wherein said playing pieces represent figurines of animate and inanimate objects.

4. A stock market big board game as recited in claim 1, wherein said game board further includes two card areas, said first area for storing said deck of market manipulation cards prior to purchase by the players and second said area for storing said deck of market fluctuation cards, whereby one said market fluctuation card is turned each time one said playing piece lands on said playing position labeled market fluctuation on said game board.

5. A stock market big board game as recited in claim 1, wherein said game board is square, with said continuous path forming a further inner square within said perimeter of said game board.

6. A stock market big board game as recited in 1, wherein said play money includes a plurality of papers bearing indicia representing denominations of money.

7. A stock market big board game as recited in claim 6, wherein said denominations of money are of $100 dollars, $500 dollars, $1,000 dollars, $5,000 dollars, $10,000 dollars, $20,000 dollars and $100,000 dollars.

8. A stock market big board game as recited in claim 1, wherein said random number generating means is a pair of dice.

9. A stock market big board game as recited in claim 1, wherein said mounting means is a clip affixed at a right angle to a bottom edge of said big board, so that said clip can engage with one edge of said game board.

10. A stock market big board game as recited in claim 1, wherein said deck of market manipulation cards allows each player that picks one of these cards to perform various manipulations, and includes thirty six cards which are five free turn cards, five cards to turn the market Bull and five cards to turn it Bear, each of seven companies represented in the game having a card to move it up twenty points, a card to move it up ten points and an SEC card to punish either of the two prior manipulations.

11. A stock market big board game as recited in claim 1, wherein said deck of market fluctuation cards includes twenty eight cards at four different volatility levels being stable, active, volatile and extremely volatile, in which the point values for the four levels are as follows: stable—four cards with a two point move, two cards with a four point move and one card with a six point move; active—four cards with a four point move, two cards with an eight point move and one card with a twelve point move; volatile—four cards with a six point move, two cards with a twelve point move and one card with an eighteen point move; and extremely volatile—four cards with a twelve point move, two cards with an eighteen point move and one card with a twenty four point move.

12. A stock market big board game as recited in claim 1, wherein said stock certificates are for each of seven companies represented on said big board, which are Global Motors; Consolidated Technologies, International Airways, United Speculators, New York Gas and Electric, Solar Power and Ralph's Shoes, wherein said stock certificates are divided into an original issue and four split levels to provide an easy and natural bookkeeping for results of the splits.

13. A stock market big board game as recited in claim 1, further including:

a) said game board having a fold line thereacross, so that said game board can be folded in half; and b) a storage box with a cover to hold said folded game board and all of the various components of the game therein when not being used.

14. A stock market big board game comprising:

a) a game board having a continuous path around its perimeter divided into consecutive spaces bearing instructions for price fluctuations of individual companies and the market as a whole, market manipulation card purchase options, penalties, bonuses for stock diversification, move anywhere options, puts and calls, market trend changes, and stock price move options with each of said spaces defining a playing position;

b) a big board;

c) means for mounting said big board vertically to said game board;

d) a plurality of price marker pegs for said big board, to indicate on said big board the activities of seven types of stocks purchased, such as stock prices and splits;

e) a plurality of playing pieces, one for each of the game players, said playing pieces being of a size to fit within said playing positions;

f) play money of different denominations for distribution of part thereof to each player;

g) a random number generating means for designating a number of spaces on said game board to be moved by each said playing piece;

h) a market trend indication piece having a bull head on one side and a bear head on an opposite side;

i) a deck of market manipulation cards;

j) a deck of market fluctuation cards;

k) a plurality of stock certificates;

l) a plurality of certificates of deposit;

m) a rules for big board pamphlet;

n) a big board regulations pamphlet;

o) a stock market primer pamphlet;

p) a big board prospectus pamphlet;

q) a stock purchases table pamphlet;

r) a stock sales table pamphlet; and s) a dividend payout and yield tables pamphlet.

15. A stock market big board game as recited in claim 14, wherein said playing pieces represent figurines of animate and inanimate objects.

16. A stock market big board game as recited in claim 15, wherein said game board further includes two card areas, said first area for storing said deck of market manipulation cards prior to purchase by the players and second said area for storing said deck of market fluctuation cards, whereby one said market fluctuation card is turned each time one said playing piece lands on said playing position labeled market fluctuation on said game board.

17. A stock market big board game as recited in claim 16, wherein said game board is square, with said continuous path forming a further inner square within said perimeter of said game board.

18. A stock market big board game as recited in 17, wherein said play money includes a plurality of papers bearing indicia representing denominations of money.

19. A stock market big board game as recited in claim 18, wherein said denominations of money are of $100 dollars, $500 dollars, $1,000 dollars, $5,000 dollars, $10,000 dollars, $20,000 dollars and $100,000 dollars.

20. A stock market big board game as recited in claim 19, wherein said random number generating means is a pair of dice.

21. A stock market big board game as recited in claim 20, wherein said mounting means is a clip affixed at a right angle to a bottom edge of said big board, so that said clip can engage with one edge of said game board.

22. A stock market big board game as recited in claim 21, wherein said deck of market manipulation cards allows each player that picks one of these cards to perform various manipulations, and includes thirty six cards which are five free turn cards, five cards to turn the market Bull and five cards to turn it Bear, each of seven companies represented in the game having a card to move it up twenty points, a card to move it up ten points and an SEC card to punish either of the two prior manipulations.

23. A stock market big board game as recited in claim 22, wherein said deck of market fluctuation cards includes twenty eight cards at four different volatility levels being stable, active, volatile and extremely volatile, in which the point values for the four levels are as follows: stable—four cards with a two point move, two cards with a four point move and one card with a six point move; active—four cards with a four point move, two cards with an eight point move and one card with a twelve point move; volatile—four cards with a six point move, two cards with a twelve point move and one card with an eighteen point move; and extremely volatile—four cards with a twelve point move, two cards with an eighteen point move and one card with a twenty four point move.

24. A stock market big board game as recited in claim 23, wherein said stock certificates are for each of seven companies represented on said big board, which are Global Motors; Consolidated Technologies, International Airways, United Speculators, New York Gas and Electric, Solar Power and Ralph's Shoes, wherein said stock certificates are divided into an original issue and four split levels to provide an easy and natural bookkeeping for results of the splits.

25. A stock market big board game as recited in claim 24, further including:

a) said game board having a fold line thereacross, so that said game board can be folded in half; and b) a storage box with a cover to hold said folded game board and all of the various components of the game therein when not being used.

* * * * *